US010041294B2

(12) United States Patent
Van Loosbroek

(10) Patent No.: US 10,041,294 B2
(45) Date of Patent: Aug. 7, 2018

(54) RETRACTABLE AND EXTENDABLE COVERING DEVICE

(75) Inventor: Patrick Franciscus Johannes Van Loosbroek, Boxtel (NL)

(73) Assignee: Unilux IP B.V., Boxtel (NL)

( * ) Notice: Subject to any disclaimer, the term of this patent is extended or adjusted under 35 U.S.C. 154(b) by 392 days.

(21) Appl. No.: 14/235,109

(22) PCT Filed: Jul. 26, 2012

(86) PCT No.: PCT/NL2012/050535
§ 371 (c)(1),
(2), (4) Date: Apr. 28, 2014

(87) PCT Pub. No.: WO2013/015689
PCT Pub. Date: Jan. 31, 2013

(65) Prior Publication Data

US 2014/0332169 A1 Nov. 13, 2014

(30) Foreign Application Priority Data

Jul. 28, 2011 (NL) ..... 2007194

(51) Int. Cl.
*E06B 9/06* (2006.01)
*E06B 9/52* (2006.01)
(Continued)

(52) U.S. Cl.
CPC ..... *E06B 9/522* (2013.01); *E06B 9/262* (2013.01); *E06B 9/52* (2013.01);
(Continued)

(58) Field of Classification Search
CPC .... E06B 9/262; E06B 9/522; E06B 2009/543; E06B 2009/2625; E06B 2009/527; E06B 9/52
See application file for complete search history.

(56) References Cited

U.S. PATENT DOCUMENTS 4,821,786 A * 4/1989 Johnston ..... E06B 9/40 16/78
5,505,244 A * 4/1996 Thumann ..... E06B 9/54 160/23.1
(Continued)

FOREIGN PATENT DOCUMENTS

EP 0999335 A1 5/2000
EP 1447517 A1 8/2004
(Continued)

OTHER PUBLICATIONS

International Search Report—PCT/NL2012/050535—dated Nov. 12, 2012.
(Continued)

*Primary Examiner* — Katherine W Mitchell
*Assistant Examiner* — Abe Massad
(74) *Attorney, Agent, or Firm* — Banner & Witcoff, Ltd.

(57) ABSTRACT

A retractable and extendable covering device (1) for architectural openings, which includes first and second substantially parallel posts (3, 5), a retractable and extendable substantially rectangular screen member (7), and a first flexible guide member (9; 109). The first flexible guide member (9; 109) is deflected into one of the first and second posts (3, 5) and slidably receivable therein. Each of the parallel posts (3, 5) has a hollow interior (19, 23), and at least one of the first and second posts being movable toward and away with respect to the other. The retractable and extendable screen member (7) has first and second pairs of opposite parallel edges and is mounted between the first and second parallel posts (3, 5) at its first pair of parallel edges. The first flexible guide member (9; 109) extends along one edge of the second pair of parallel edges of the screen member (7) and between the first and second posts (3, 5) for retaining the one edge of the screen member (7). The first and second parallel posts (3, 5) each include a base profile
(Continued)

part (69; 169) and an auxiliary profile part (71; 171) defining the hollow interior (19, 23) therebetween for slidably receiving the first flexible guide member (9). Optionally the auxiliary profile part (71; 171) is mountable to the base profile part (69; 169) in a selected one of two different positions in which it is connectable to the base profile.

22 Claims, 19 Drawing Sheets

(51) Int. Cl.
*E06B 9/262* (2006.01)
*E06B 9/54* (2006.01)

(52) U.S. Cl.
CPC . *E06B 2009/2625* (2013.01); *E06B 2009/527* (2013.01); *E06B 2009/543* (2013.01)

(56) References Cited

U.S. PATENT DOCUMENTS 6,318,438 B1 * 11/2001 Uno ..... E06B 9/262 160/194
7,322,395 B2 * 1/2008 Nyffenegger ..... E06B 9/54 160/265
7,472,738 B2 * 1/2009 Kamosawa ..... E06B 9/52 160/243
7,730,926 B2 * 6/2010 Moriya ..... E06B 9/262 160/84.04
7,984,744 B2 * 7/2011 Karasawa ..... E06B 9/262 160/84.03
2004/0244919 A1 * 12/2004 Aoki ..... E06B 9/262 160/218
2007/0029053 A1 * 2/2007 Moriya ..... E06B 9/262 160/84.06
2009/0266495 A1 * 10/2009 Karasawa ..... E06B 9/262 160/84.03
2011/0100570 A1 * 5/2011 Licciardi Di Stefano ..... E06B 9/581 160/368.1
2011/0203752 A1 * 8/2011 Okachi ..... E06B 9/54 160/372
2013/0118694 A1 * 5/2013 Moriya ..... E06B 9/262 160/84.04

FOREIGN PATENT DOCUMENTS

EP 1653038 A1 5/2006
EP 1903175 A2 3/2008
EP 1903175 B1 11/2010
JP 2005023578 A 1/2005
JP 2007154425 A 6/2007
JP 2010037858 A 2/2010

OTHER PUBLICATIONS

International Preliminary Report on Patentability—PCT/NL2012/050535—dated Feb. 6, 2014.

* cited by examiner

RETRACTABLE AND EXTENDABLE COVERING DEVICE

CROSS-REFERENCE TO RELATED APPLICATIONS

This application is a U.S. National Stage application under 35 U.S.C. § 371 of International Application PCT/NL2012/050535 (published as WO 2013/015689 A1), filed Jul. 26, 2012, which claims priority to Application NL 2007194, filed Jul. 28, 2011. Benefit of the filing date of each of these prior applications is hereby claimed. Each of these prior applications is hereby incorporated by reference in its entirety.

The invention relates to a retractable and extendable covering device for architectural openings. Such covering devices may be in the form of screens that enable ventilation while keeping out insect, but may also be useful in tempering sunlight.

Various examples of such screening devices are known in the prior art, and one popular variation of insect screen uses a pleated screen to seal an architectural opening against the ingress of insects. This type of window screen does not need a spring for its retraction, and as a result can be operated with very little effort and almost noiselessly. Typically these screens, when installed at door openings, use flexible guide members, which are conveniently formed as a movable plastic caterpillar chain that allows a substantial reduction in height of the bottom guide rail, when the screen door is opened for access. The caterpillar chain disappears into the vertical operating profile and serves as a guide for the pleated screen when the screen is extended to cover the door opening. Since storage space for the caterpillar chain is limited by the height of the vertical operating profile, there are limitations to the with of the door opening that can be covered by this type of screen. This is in particular the case, when both the top and the bottom caterpillar chains disappear into the vertical operating profile. Because there is also an interest in keeping the operating profile as shallow as possible the height for storage available in the vertical operating profile often had to be shared between the top and bottom caterpillar chains. To increase the maximum width that can be covered by such insect screen doors, there have been proposals to reduce the space required for storing the caterpillar chains, or flexible guide member. One such proposal is described in European patent EP 1447517, which has eliminated the top flexible guide member and replaced this by a conventional guiding cord. The arrangement according to EP 1447517 allows more or less the full height of a vertical profile to be used for storage of the bottom chain. Nonetheless the top guiding cord and the bottom flexible guide member display different frictional behaviour, which tends to impair the operating smoothness and reliability. Another solution proposed by European patent EP 1903175 uses top and bottom chains that differ in cross sectional dimension, so that the top chain can slide partially within the bottom chain. While the solution of EP 1903175 has retained to some extend the operational characteristics provided by top and bottom chains, it has also at the same time increased the number of different parts and complicated manufacture. Also it has only enabled a slight reduction in size of the vertical profile, which still has to accommodate the top and bottom chains alongside one another. From European patent publication EP 1653038 it is also known to provide a version of a horizontally drawable screen door, in which one flexible net guide moves in and out from an upper end of a movable vertical frame member, while another flexible net guide moves in and out from a lower end of another fixed vertical frame member.

It has been felt as a drawback of the existing guided screen devices that, while these can be readily mounted within the frame of an architectural opening, it requires additional hardware, such as auxiliary frames, to mount the same in front of architectural openings. Apart from being costly and cumbersome, such auxiliary frames do not enhance the unobtrusive character that should be associated with this type of home improvement product.

Accordingly it is an object of the present invention to propose an improved retractable and extendable screen device. In a more general sense it is thus an object of the invention to overcome or ameliorate at least one of the disadvantages of the prior art. Generally the invention is aimed at reducing the effort in assembly and stock keeping of parts, as well as reducing the effort in installation and adjusting of the finished product. It is also an object of the present invention to provide alternative structures which are less cumbersome in assembly and operation and which moreover can be made relatively inexpensively. Alternatively it is an object of the invention to at least provide the public with a useful choice.

To this end the invention provides a retractable and extendable screen device as defined in the appended claims. In particular the invention includes a retractable and extendable covering device for architectural openings, that includes: first and second substantially parallel posts, each having a hollow interior, and at least one of the first and second posts being movable toward and away with respect to the other of the first and second posts; a retractable and extendable substantially rectangular covering member having first and second pairs of opposite parallel edges and being mounted between the first and second parallel posts at the first pair of parallel edges; a first flexible guide member extending along one edge of the second pair of parallel edges and between the first and second posts for retaining the one edge of the covering member; and the first flexible guide member being deflected into the hollow interior of one of the first and second posts and being slidably receivable therein, wherein the first and second posts each include a base profile part and an auxiliary profile part defining the hollow interior therebetween. This feature enhances assembly as it makes the hollow interior of the posts accessible during assembly for inserting the flexible guide member therein.

Preferably the auxiliary profile part is mountable to the base profile part in a selected one of two different positions. This further option eliminates or reduces the need for additional post profiles for different installations.

Advantageously the first and second posts can be substantially identical, which further reduces the number of different parts and simplifies stock keeping and assembly.

In this regard it may also be preferred when a second flexible guide member extends along the other edge of the second pair of parallel edges of the covering member for retaining the other edge, and wherein the second flexible guide member is deflected and slidably receivable within the hollow interior of one of the first and second posts other than that in which the first flexible guide member is received. Rather surprisingly the movement in opposite directions of the first and second flexible guide members with respect to the covering member has had little or no effect on the proper deployment of the covering device. As a result of using both of the vertical posts for storage of the flexible guide members has enabled to make optimal use of the available storage length, while still enabling these posts to be slim enough not to be obtrusive.

Favourably one specimen of a first type of end member may be mounted to a first longitudinal end of the first post and another specimen of the first type of end member may be mounted to a second longitudinal en of the second post. Likewise one specimen of a second type of end member may be mounted to a second longitudinal end of the first post and another specimen of the second type of end member may be mounted to a first longitudinal end of the second post. A further advantage of having identical first and second posts is that end members can be shared for attachment to ends of each of the first and second posts. In a preferred embodiment a first type of end member is used to attach one end of a flexible guide member, while a second type of end member is used to slidably guide the another end of a flexible guide member into the hollow interior of a post.

In another preferred embodiment the flexible guide member has a transverse cross section adapted to accommodate an edge of the second pair of parallel edges of the covering member, which edge extends between the first and second posts. When the edge of a pleated screen is simply restrained between opposite flanges of a flexible guide member, then there is no need to form any slots or notches at the edge of the pleated screen. Conveniently the flexible guide member is also adapted to engage a fixed guide rail by defining a formation that is complementary to a transverse contour of the fixed guide rail. Such a fixed guide rail ensures that the flexible guide member follows a straight path between to retracted and extended positions of the covering device. At the same time such a fixed guide rail can be very shallow and unobtrusive when the covering device is retracted. This is generally a benefit when the covering device is used in door openings that should also provide access for persons.

Each of the flexible guide members preferably also includes a plurality of pivotally interconnected chain links. As opposed to flexible guide members that are flexible by resilience, a pivotally interconnected caterpillar type of flexible guiding members has a greater flexibility and does not oppose deflecting from a straightened relaxed position. In addition thereto it is advantageous when each chain link comprises side flanges, which are laterally spaced by a central web that is aligned with the pivot connections, and wherein the central web and pivot connections are asymmetrically positioned to define a cavity for receiving the covering member edge that is deeper than a cavity for engaging the fixed rail. Contrary to what has been accepted practise, it has turned out not to be necessary at all for the chain links to be symmetrical with respect to their pivot axes. As the invention has shown it is possible to further reduce the cross sectional size of the chain links by reducing their extend on at least one side of the central web.

The second end member also preferably includes a guide member deflector for deflecting one of the first and second flexible guide members into a relevant one of the first and second posts. In particular it is thereby of advantage when the guide member deflector is part of a separate guiding insert that is removable mounted to the second end member. Such an arrangement allows the guiding insert to be manufactured from more wear resistant materials, such as Zamak (a well known zinc alloy) or Ultem (a Polyetherimide resin developed by General Electric Plastics), which is usually too expensive as a material for the entire end member. Even when the guide member deflector is made from a less wear resistant material, it can still be easily replaced. The guiding insert can further also be provided with guiding means for a fixed guide rail, with the same benefits of counteracting wear.

A retractable and extendable covering device according to the invention can further benefit when at least one tension cord extends parallel to the second pair of parallel edges of the covering member and through aligned openings or eyelets of the covering member. One or more tension cords will enable a greater distance between the first and second flexible guide members, which translates into either a greater possible height or a greater possible width of the covering device, depending on its installation.

It may also be of further advantage when both the first and second post are movable for retracting and extending the covering member. This gives an option of opening the covering device from any selected end, be it left or right or top or bottom, depending on its installation.

In particular in an installation where the first and second posts are vertically directed it may be advantageous to have ends on one side of the parallel first and second posts guided by a valance profile. This allows for any gaps, which would otherwise permit light or insects to pass the covering, to be effectively blocked. Use of a valance profile may also simplify guidance of the movable posts and assembly operations. Assembly can also be further enhanced when the valance profile has a separately attached front wall.

In a particular advantageous embodiment of the invention the covering member is a pleated insect screen and the covering device is an insect screen door.

Further advantageous aspects of the invention will become clear from the appended description and by reference to the accompanying drawings, in which.

Figure 1:
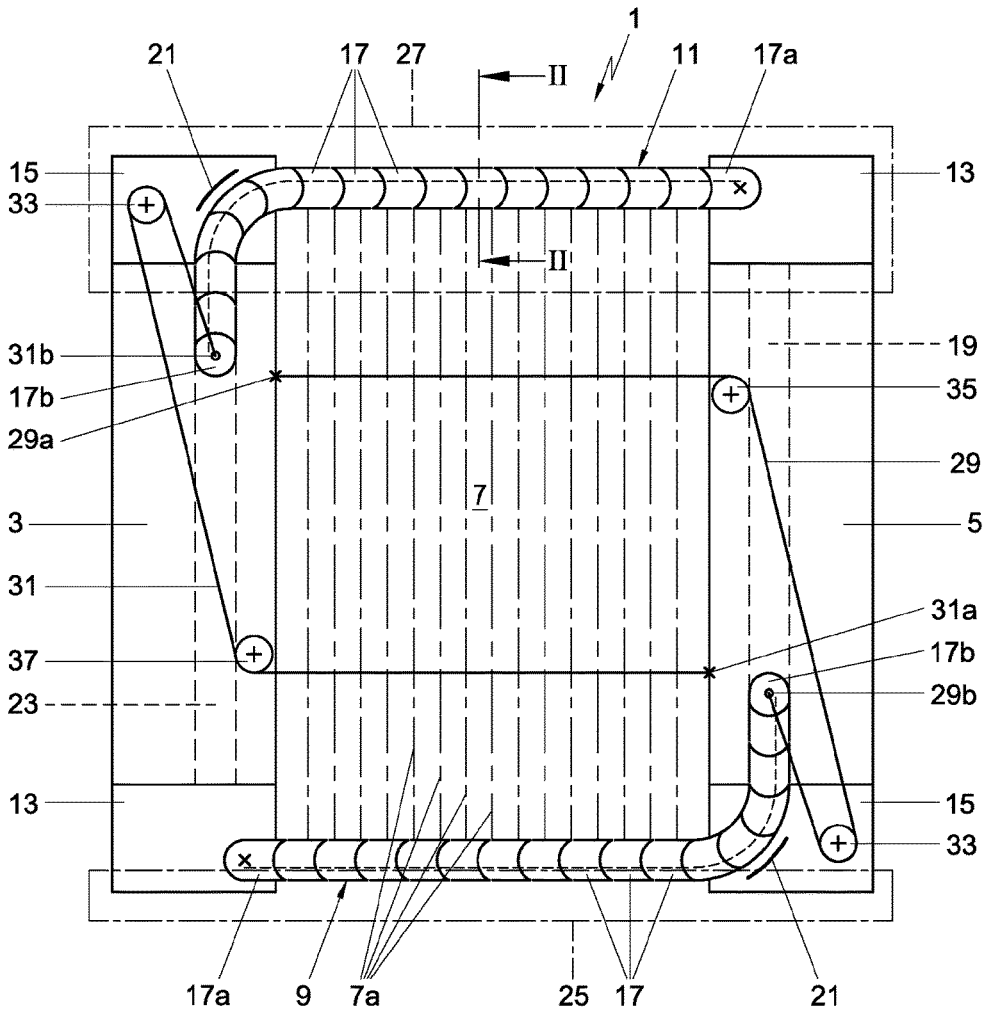
FIG. 1 is a schematic front view of an embodiment of covering device for an architectural opening in accordance with the present invention.

In FIG. 1 an embodiment of the inventions is schematically illustrated as a retractable and extendable covering device 1. The covering device 1 can be a slidable insect screen or a sun screen for covering in its extended position an architectural opening, such as a window or door (not shown, but conventional). The covering device 1 has first and second parallel posts 3, 5 with an extendable and retractable screen member 7 extending there between. First and second flexible guide members 9, 11 extend along those edges of the screen member 7 that are not attached to one of the first and second parallel posts 3, 5. Each of the first and second posts 3, 5 is provided with one first end member 13 and one second end member 15. As represented in FIG. 1, the first end member 13 of the first posts 3 is positional at a longitudinal bottom end thereof. A similar first end member 13 is positioned at a longitudinal top end of the second post 5. Conversely one second end member 15 is positioned at the top end of the first post 3 and another one at the bottom end of the second post 5. It will though be clear to the skilled person that the arrangement may also be in mirror image, or that the first and second posts 3, 5 may extend horizontally with the flexible guide members 9, 11 in a vertical orientation. Each of the first and second flexible guide members 9, 11 is composed of a plurality of individual chain links 17 that are articulated to one another by a hinge connection, as will be described in further detail herein below. The first flexible guide member 9 has a first end link 17*a* fixedly attached to the first end member 13 at the bottom of the first post 3. A second end link 17*b* is slidable guided and accommodated within a guide track 19 of the second post 5. The second end member 15 at the bottom of the second post 5 is provided with a guide member deflector 21 for deflecting the first flexible guide member 9, which can be likened to a caterpillar chain, into the guide track 19. At least one of the first and second parallel posts 3, 5 is moveable to and from the other of the first and second posts 3, 5, so as to retract or extend the screen member 7 that is mounted there between. As is further apparent from FIG. 1, the second flexible guide member 11 may have a first end one of its links 17*a* attached to the first end member 13 that is positioned on top the second post 5. A second end link 17*b* of the second guide member 11 may again be arranged for sliding accommodation within a guide track 23 of the first post 3. For this purpose second end member 15 on top of the first post 3 also has a guide member deflector 21. When the first and second posts 3, 5 are moved relative to on another, the first and second flexible guide members 9, 11 will be accommodated to a greater or lesser extent in the respective first and second post 3, 5. Although one of the first or second post 3, 5 will preferably be fixed to one side of an architectural opening, it is also conceivable that both first and second posts 3, 5 are movable to give an option to either opening the covering device 1 selectively from left to right or from right to left. To assist the first flexible guide member 9 to move along a straight path, a relatively flat guide rail 25 may be fixedly mounted to a floor or a sill surface adjacent the architectural opening with which the covering device 1 is associated. This fixed guide rail 25 is arranged to engage with complementary formations of the first flexible guide member 9. While a similar arrangement may be provided for the second flexible guide member 11, at the top of the screen member 7, this is usually not considered necessary or desirable. Accordingly the top edge of the screen device 1 is covered by a valance profile 27, which may include only guidance for the first and second end members 13, 15 at the top of the respective first and second posts 3, 5. While the screen member 7 may optionally be a roller screen that is held under tension by a spring roller or the like, the embodiment of FIG. 1 includes an accordion pleated screen material. With such a pleated screen as screen member 7, it is possible to guide the top and bottom edges thereof only by engagement with the first and second flexible guide members 9, 11. However when the distance between the first and second flexible guide members 9, 11 becomes substantial with increasing height dimensions of the covering device 1, it may be necessary to provide additional stabilizing means in the form of tension cords 29, 31. Each tension cord 29, 31, of which several may be provided in accordance with the dimension of the screen member 7, extends through openings between alternating pleats 7*a* of the screen member 7, so as to extend in parallel to the first and second flexible guide members 9, 11. The tension cord 29 is affixed with one end 29*a* to the structure of the first post 3. An opposite end 29*b* of tension cord 29 is affixed to the second end link 17*b* of the first flexible guide member 9. The tension cord 29 is routed from its opposite end 29*b* about a return guide 33 in the second end member 15 and is further deflected in a direction parallel to the first and second guide members 9, 11 by a redirection guide 35 in the second post 5. Both the return guide 33 and the redirection guide 35 may be embodied as pulley wheels, as is schematically indicated in FIG. 1, but may also be formed by wear resistant guiding surfaces. A similar arrangement is used for the further tension cord 31. The routing of the further tension cord 31 includes a first end 31*a* affixed for the second post 5, a redirection guide 37 in the first post 3, a return guide in a second end member 15 on top of the first post 3, and a second end 31*b* affixed to the second end link 17*b* of the second flexible guide member 11 for movement therewith.

Figure 2:
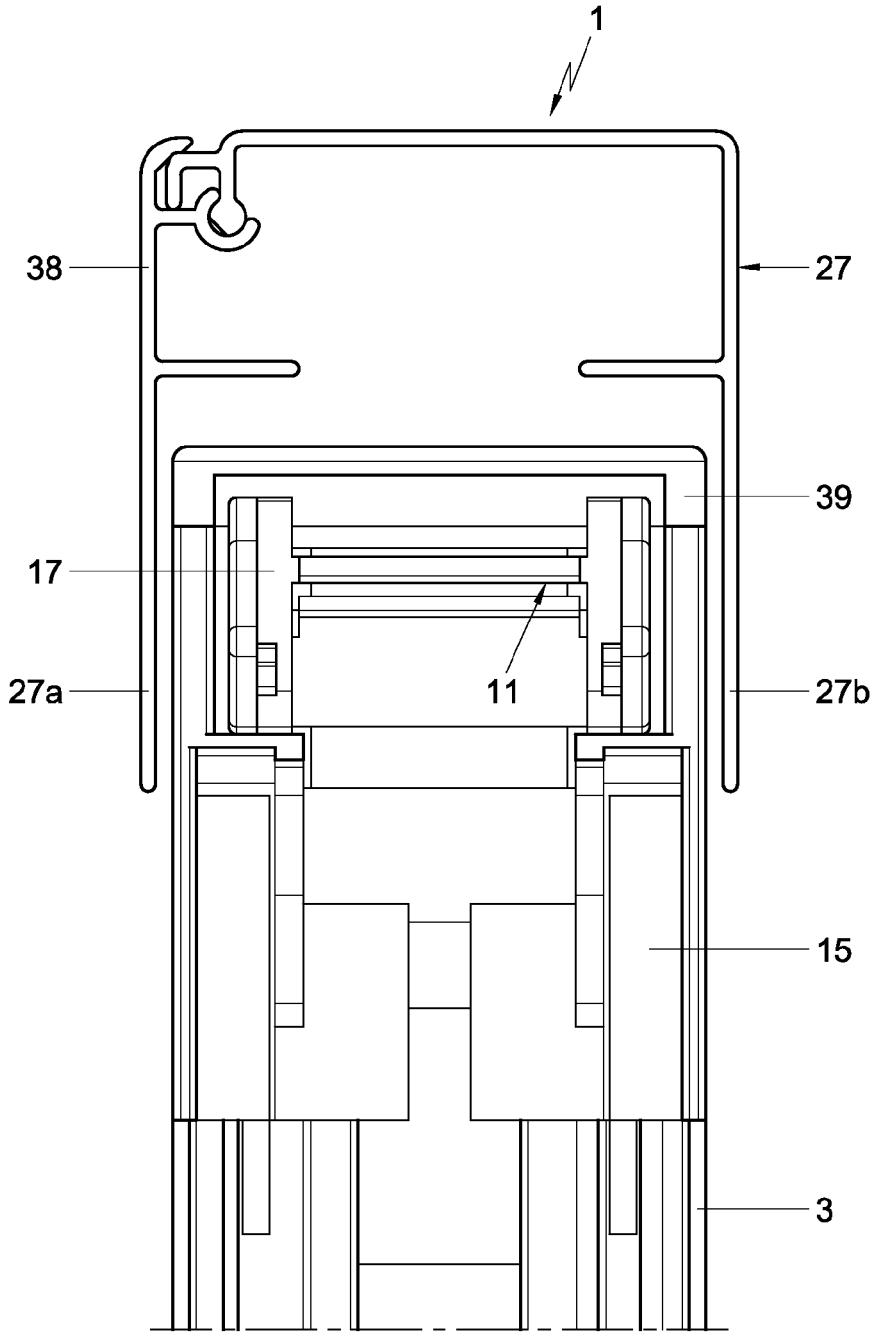
FIG. 2 is a partial transverse cross section as viewed in the direction of arrows II-II of FIG. 1.

Reference will now briefly be had to FIG. 2, which is a partial transverse cross section of on possible valance profile 27 as seen in the direction of arrows II-II of FIG. 1. In FIG. 2 it is seen that the valance profile 27 has downwardly depending front and back flanges 27*a*, 27*b*. The front and back flanges 27*a* and 27*b* are snugly juxtaposed at opposite faces of the second end member 15 at the top of post 3, to guide same along a straight path when post 3 is movable and being moved. Conversely the first end member 13 on top of the second post will be similarly guided by the valance profile 27 when the second post 5 is movable and being moved. Further indicated in FIG. 2 is the position of the chain link 17 of the second flexible guide member 11. The depending front flange 27*a*, as shown in FIG. 2, may be part of a disconnectable separate front wall 38 of the valance profile 27. Such as separately attached front wall 38 may be very convenient when installing the covering device 1 at a architectural opening. The second end member 15 may also optionally be provided with an additional lid 39 as will be further discussed herein below. The separately attachable front wall 38 of the top guiding valance profile 27 is also of advantage when directly mounting the valance profile 27 to a frame of an architectural opening, or in front of such an architectural opening. With the front wall 38 not yet positioned it is possible to have easy access to any mounting screws for attachment to a building structure.

Figure 3:
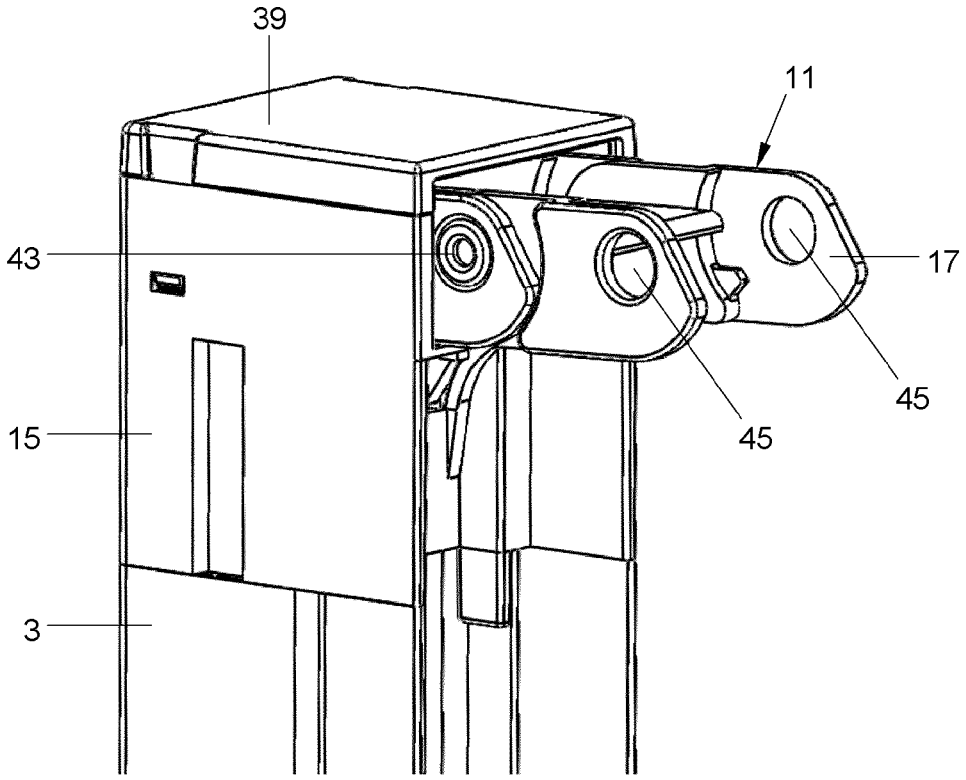
FIG. 3 is a partial perspective view of a left hand top portion of a covering device in accordance with FIG. 1.

FIG. 3 is a partial perspective view of the left hand top portion of FIG. 1 and shows the top end of the first post 3. Also shown is a portion of the second flexible guide member 11 and the chain links 17 exiting the second end member 15. Each link 17 is provided with a pin 43 and aperture 45 forming a hinge connection. As shown here, the second end member 15 is closed off at its top end by the optional additional lid 39.

Figure 4:
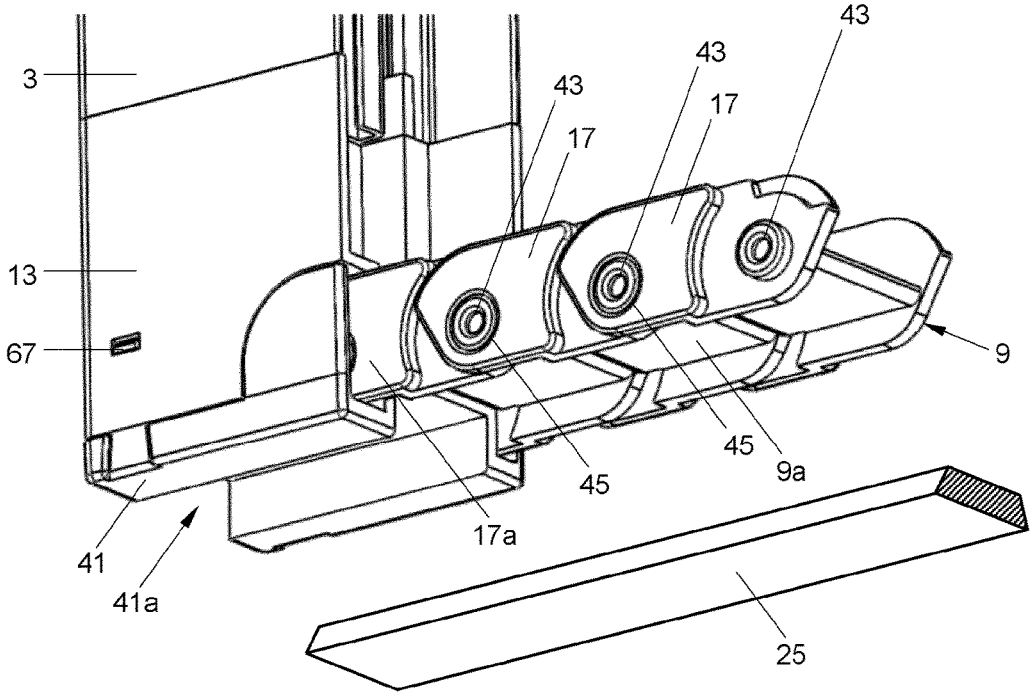
FIG. 4 is a partial perspective view in an exploded arrangement of a left hand bottom portion of a covering device in accordance with FIG. 1.

FIG. 4 is a partial perspective view in an exploded arrangement of the left hand bottom portion of the covering device 1 of FIG. 1. FIG. 4 shows the first end member 13 as fitted to the bottom end of first post 3. To enable the first end member 13 to be slidably guided by the fixed guide rail 25 (for clarity shown spaced from its operative position), a special lid 41 may be fitted at the bottom of the first end member 13. The special lid 41 is provided with a recess 41*a* that has a cross section complementary to the guide rail 25. Also the first flexible guide member 9 is seen to form a complementary cavity 9*a* for the same purpose of being guided by the guide rail 25. The flexible guide member 9 has its individual links 17, pivotally hinged to one another. The respective hinge connections comprise the pin 43 on one link 17 and the aperture 45 on a confronting link 17. Conceivably the flexible guide members could optionally be formed without pivots, as a continuous element in which the links are integrally connected by living hinges or the like. Such alternative, as well as others, are well known to the skilled person and do not require any detailed disclosure for the purpose of explaining the present invention.

Figure 5:
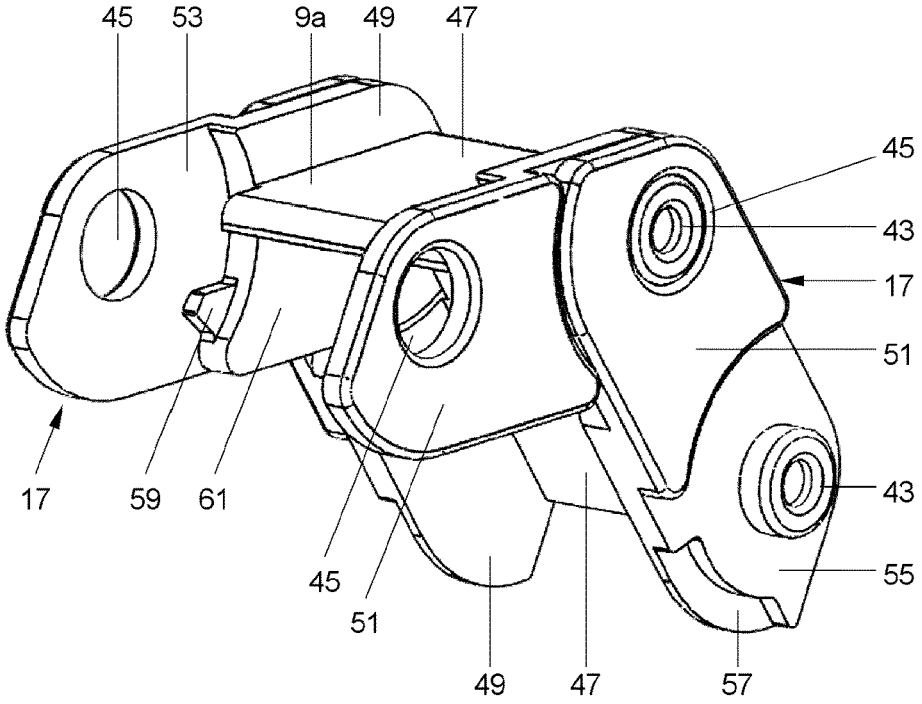
FIG. 5 is a perspective view of two pivotally interconnected links of a caterpillar chain guiding member.
Figure 6:
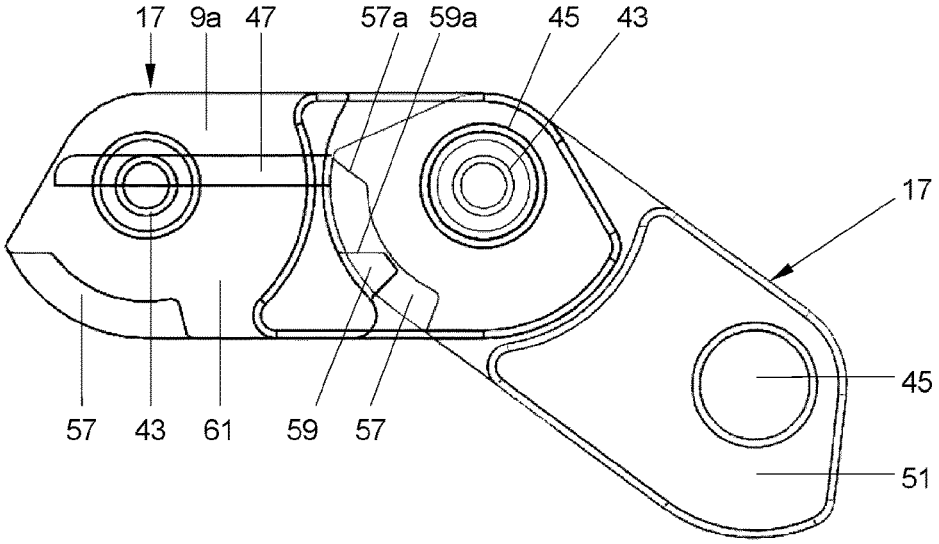
FIG. 6 is a ghost view elevation of the two pivotally interconnected links of FIG. 5.

FIG. 5 is perspective view of two of the pivotally interconnected chain links 17. Each link 17 is composed of a central web 47 and opposite side flanges 49, 51. Each opposite side flange 49, 51 is recessed on an inside face, at 53 and on an outside face at 55. The inside face recess 53 coincides with the location of the aperture 45, while the outside face recess coincides with the location of the pin 43. When made in a flexible and resilient material, such as plastic, the pin 43 may be easily snap fitted into the apertures 45 on adjacent chain links 17 by flexing of the opposite flanges 49, 51. In FIG. 5 the position between the adjacent chain links 17 is that of maximum pivotal deflection with portions of an outer contour of the opposite side flanges 49, 51 of one chain link 17 abutting against an edge formed by the outside face recess 55. Further it is visible in FIG. 5 that the outside face recess 55 has an arc-shaped further recess 57 and that the inside face recess 53 has a protruding notch 59. As can be seen in the ghost-view elevation of FIG. 6, the protruding notch 59 cooperates with the arc-shaped recess 57 to limit the pivotal deflection in a direction opposite from that shown in FIG. 5. When from the position shown in FIG. 6, the adjacent chain links 17 will be pivoted until their pins 43 and aperture 45 are all aligned along a straight line, a confronting notch edge 59*a* and a confronting arc recess edge 57*a* will abut one another. Thereby the pivoting chain links 17 in one direction will only permit the flexible guide members 9, 11 to be straight, whereas articulation is only permitted to one side of the straight position. This feature is of importance when the second flexible guide member 11 at the top of the covering device should not be resting with its full weight on the top edge of the pleated screen member 7. A further feature that is apparent from FIGS. 5 and 6 is that the central web 47 of the chain links 17, as well as the pins 43 and apertures 47 making up the hinge connections, are positioned asymmetrically with respect to the height of the opposite side flanges 49, 51. The positioning of the central web 47 thereby is such that a cavity 61 is formed for accommodating an edge of screen member 7 that is relatively large in comparison to the cavity 9*a* for the fixed guide rail 25. As the edge of the screen member 7 tends to be rather flexible and non-rigid, it will benefit from the support provided by a deeper cavity 61. In contrast the guide rail 25 is relatively flat and rigid and the cavity 9*a* needs only to be shallow to provide an adequate interlock.

Figure 7:
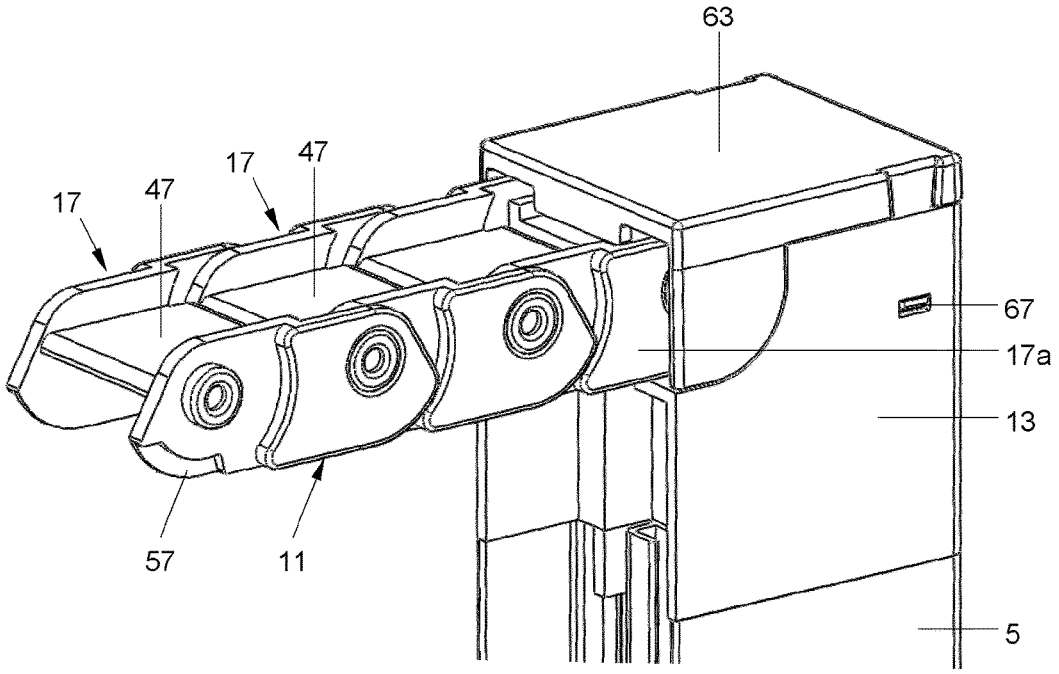
FIG. 7 is a partial perspective view of a right hand top corner of a covering device in accordance with FIG. 1.
Figure 8:
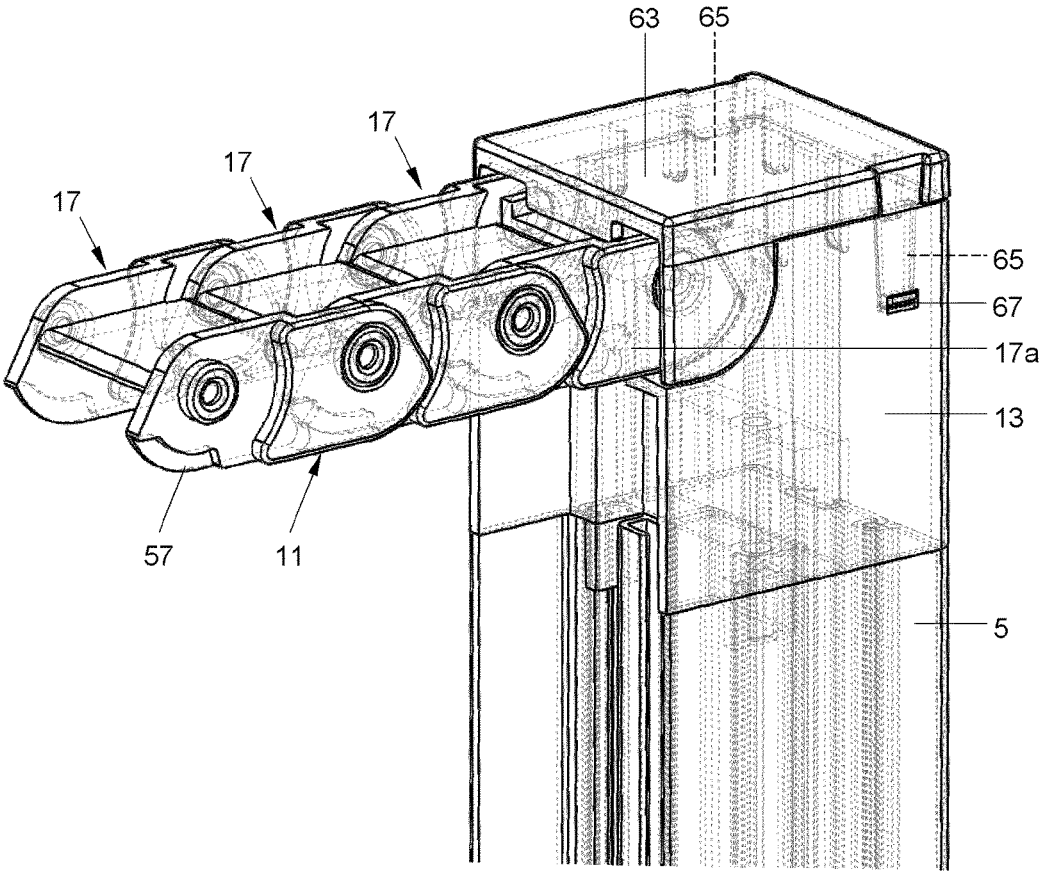
FIG. 8 is a ghost view of the partial view of FIG. 7.

FIGS. 7 and 8 each show the right hand top corner of the covering device 1 as represented in FIG. 1. FIG. 8 is a ghost view of the partial view of FIG. 7. The top end of the second post 5 here carries a specimen of the first end member 13. Also shown is a portion of the second flexible guide member 11, which has its first end link 17*a* connected to the first end member 13. The first end member 13 can have its top end closed off by an optional lid 63. This optional lid 63 can be deleted when the first end member 13 is hidden behind the valance profile 27 (shown in FIGS. 1 and 2), or may than also be of the same type as special lid 41 (shown in FIG. 4). It can also be recognised from FIGS. 7 and 8 that the lid 63 has a pair of depending tongues 65 having a detent engaged in an opening 67 in the outer wall of the first end member 13 for its attachment.

Figure 9:
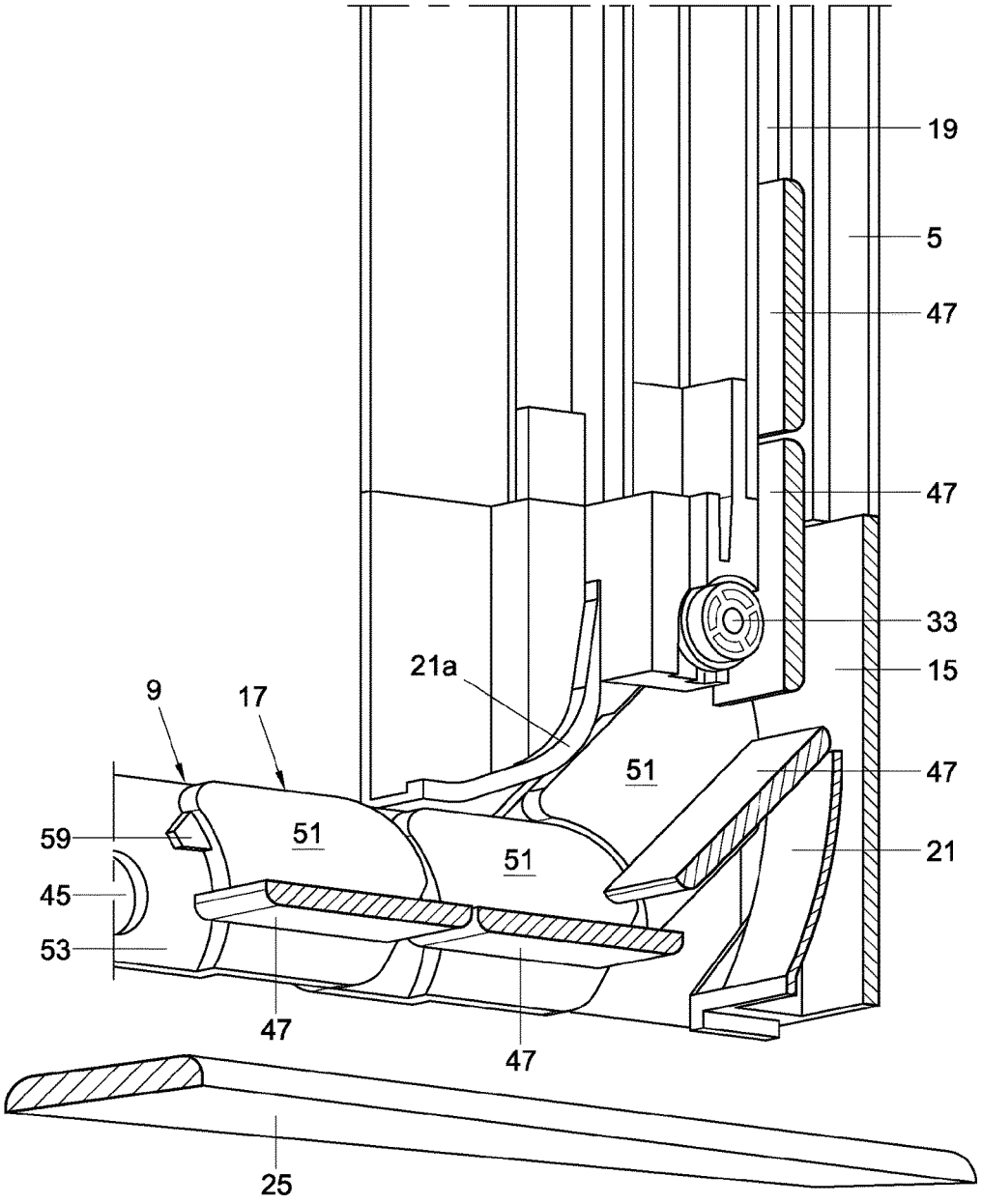
FIG. 9 is a partial perspective view in cross section of a lower right hand corner of a covering device in accordance with FIG. 1.

FIG. 9 is a partial perspective view in cross section of a lower right hand corner of the covering device 1 as shown in FIG. 1. The guide rail 25 is shown in an exploded arrangement in which it is spaced from the second end member 15. The second end member 15 is here mounted to a lower end of the second post 5 in which guide track 19 extends for guiding the chain links 17 of the first flexible guide member 9. The chain links 17 which are also shown in cross section can be recognised by their central webs 47. The chain links 17 can thereby also be seen to be deflected from extending parallel to the guide rail 25 to being vertically aligned with the second post 5 when being guided by the guide track 19. Deflection of the chain links 17 into and out of the second post 5 is effected by the guide member deflector 21 in the second end member 15. Deflection of the chain links 17 may be further guided by a guide surface 21*a* that is opposite of the guide member deflector 21 forming an inside corner. It is further seen that a pulley wheel is provided as the return guide 33 in the second end member 15 for guiding the tension cord 29 (not shown in FIG. 9, but already explained in reference to FIG. 1).

Figure 10:
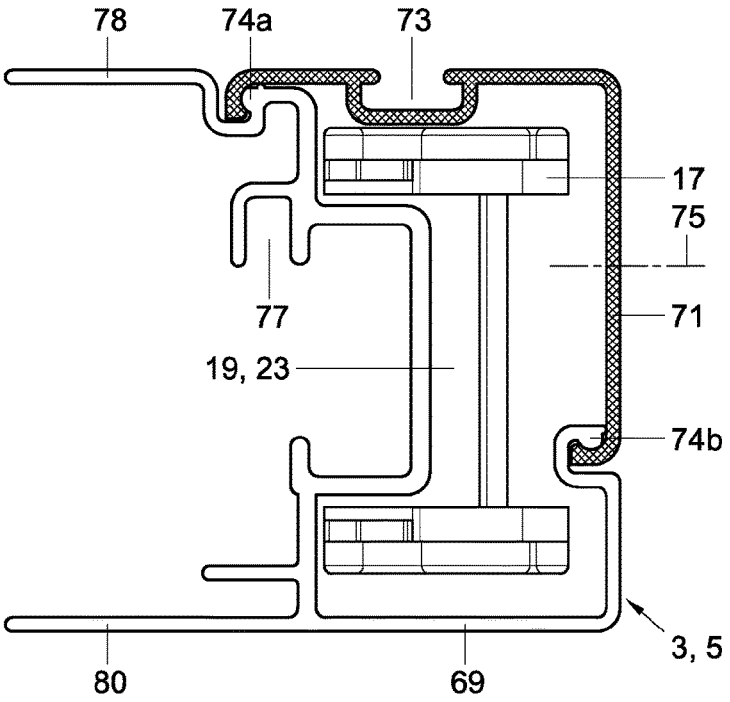
FIG. 10 is a longitudinal end view of a profile assembly as used to form vertical posts of the covering device of FIG. 1.
Figure 11:
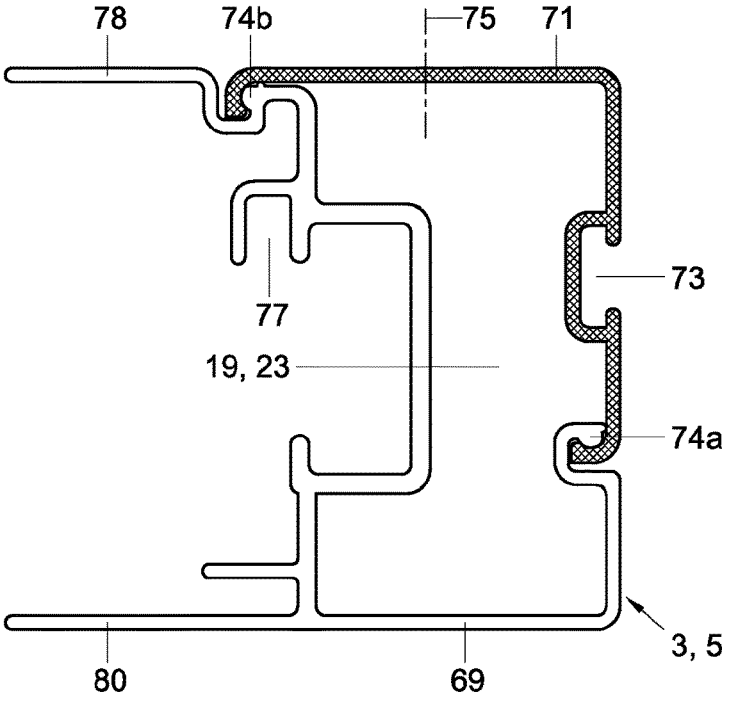
FIG. 11 is a longitudinal end view of a profile assembly as in FIG. 10, but assembled differently.

FIGS. 10 and 11 are longitudinal end views of the of the first and second posts 3, 5 in alternative situations. Each of the first and second posts 3, 5 may advantageously be assembled from an identical base profile 69 and an auxiliary profile 71. The auxiliary profile 71 has an longitudinally extending dovetail groove 73 and can be mounted to the base profile 69 in a selective one of two different positions. As shown in FIG. 10, the auxiliary profile 71 is mounted in a first position with the dovetail groove 73 opening to a front or rear face of the covering device 1. The auxiliary profile attaches to the base profile 69 by snap-fit formations 74*a*, 74*b* on longitudinal edges of the auxiliary profile 71 that are complementary in form to similar longitudinal formations on the base profile 69. As shown in FIG. 11, the auxiliary profile 71 is alternatively mounted in a second position with the dovetail groove 73 opening to an outer edge of the covering device 1. The snap-fit formations 74*a*, 74*b* are equivalent and exchangeable with one another. The dovetail groove 73 can function in receiving mounting hardware, draught or bristle profiles, handles, latches or like accessories. The auxiliary profile 71 is of substantially L-shaped configuration, and a face of it other than that carrying the dovetail groove 73 may be used for accepting mounting fasteners, as schematically indicated by a centre line 75. The fastener centre line 75 may represent pre-drilled mounting holes, or may represent an integrally formed groove for the guidance of a drill. In FIG. 10 it is additionally illustrated how the interior of the base profile 69 forms the guide track 19, 23 for guiding and accommodating the chain links 17. Further locating means 77 are provided on the base profile 69 for mounting of the screen member 7 and first and second flanges 78, 80 for covering a pleated screen member 7 when retracted. The two positions of the auxiliary profile 71 are particularly useful to cope with the alternative mounting options of the covering device 1 in respect of an architectural opening. When mounting within the frame of an architectural opening, the auxiliary profile 71 may be positioned as shown in FIG. 10 and attaching fastener elements may directly attach in accordance with the centre line 75 to a confronting frame member. Conversely with the auxiliary profile 71 positioned as shown in FIG. 11, the covering device may be directly mounted to a wall surface surrounding the architectural opening.

Having the posts 3, 5 arranged as an assembly of the base profile 69 and the auxiliary profile 71 mountable in a selective one of two different positions, brings the advantage of reducing stock keeping and also allows for modification of the product prior to installation. The specific arrangement as explained in reference to FIGS. 10 and 11 also allows the interior of the posts 3, 5 to be accessible during assembly of the covering device product, which was not possible with the prior art.

Figure 12:
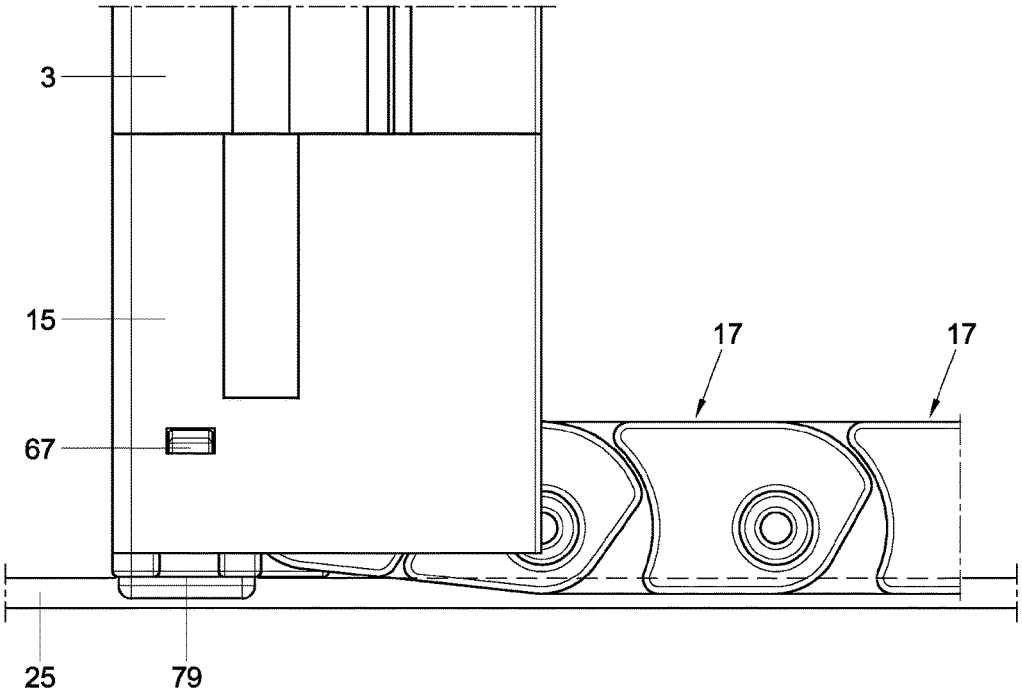
FIG. 12 is a partial elevation of an alternative arrangement for the left hand bottom portion shown in FIG. 4.
Figure 13:
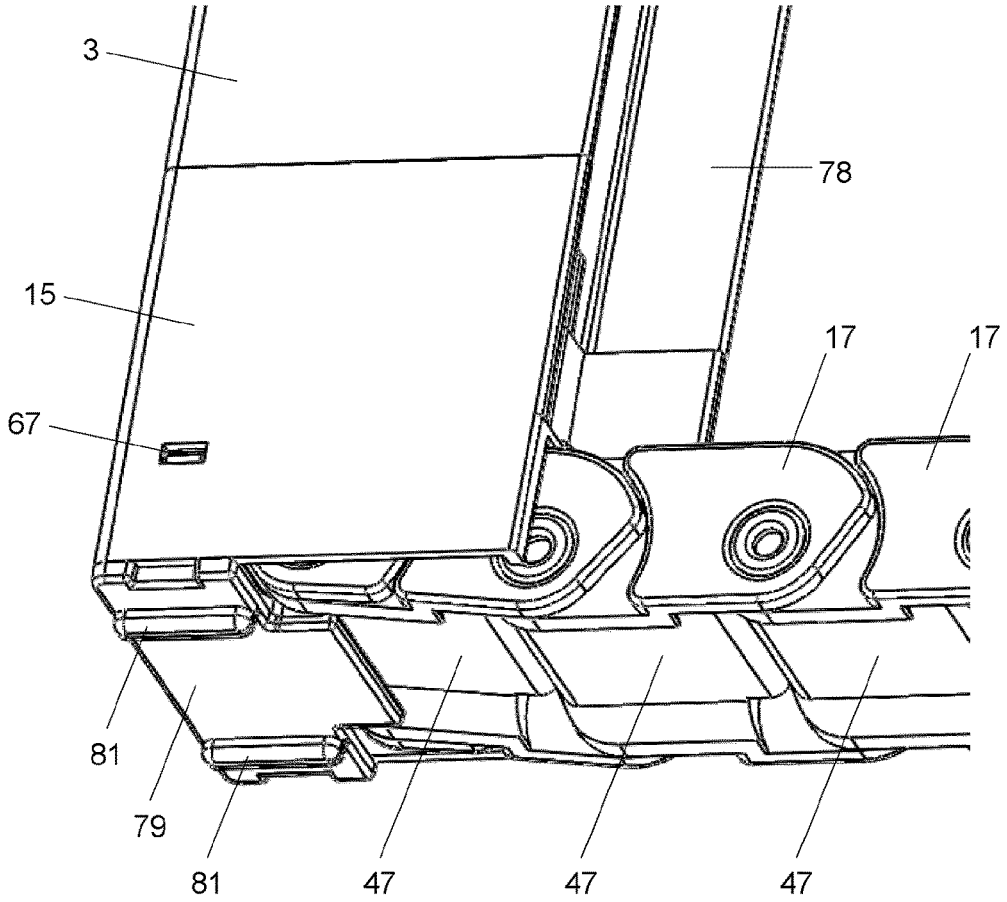
FIG. 13 is a partial perspective view of the alternative left hand bottom portion shown in FIG. 12.

FIGS. 12 and 13 illustrate an alternative arrangement of the left hand bottom portion for the covering device of FIG. 1. A first deviation from the arrangement shown in FIG. 4 is that a second end member 15 is now fitted to the bottom of the first post 3. The fitting of a specimen of the second end member 15 to the first or left hand post 3 corresponds effectively to a mirror image arrangement of the covering device 1, as shown in FIG. 1. A further important deviation is that the (in this case) second end member 15 is not guided by a special lid (such as 41 in FIG. 4), but rather by a guiding insert 79. The opening 67 is used to retain the guiding insert 79 in position with respect to the second end member 15. FIG. 13 is a partial perspective view of the arrangement of FIG. 12 as viewed from below and with the guide rail 25 deleted for clarity. FIG. 13 also illustrates that the guiding insert 79 has a pair of guiding notches 81 to engage opposite sides of the guide rail 25 as shown in FIG. 12.

Figure 14:
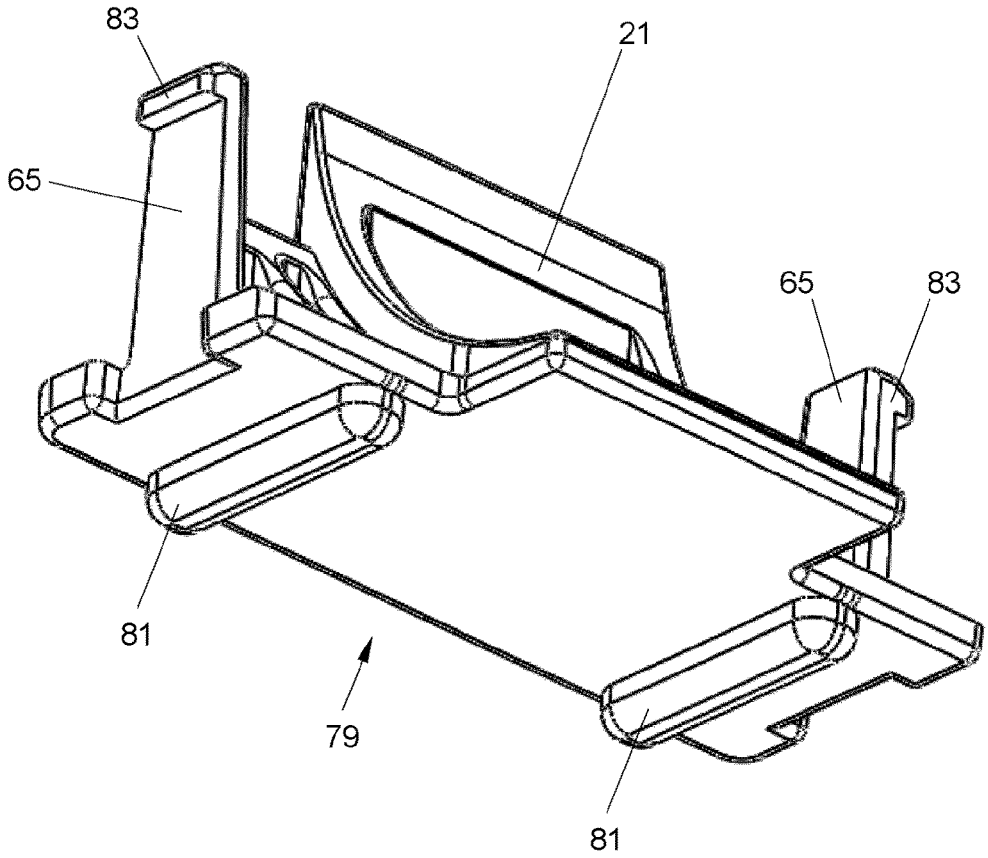
FIG. 14 is a perspective view from below of a guiding insert used in the alternative embodiment of FIGS. 12 and 13.
Figure 15:
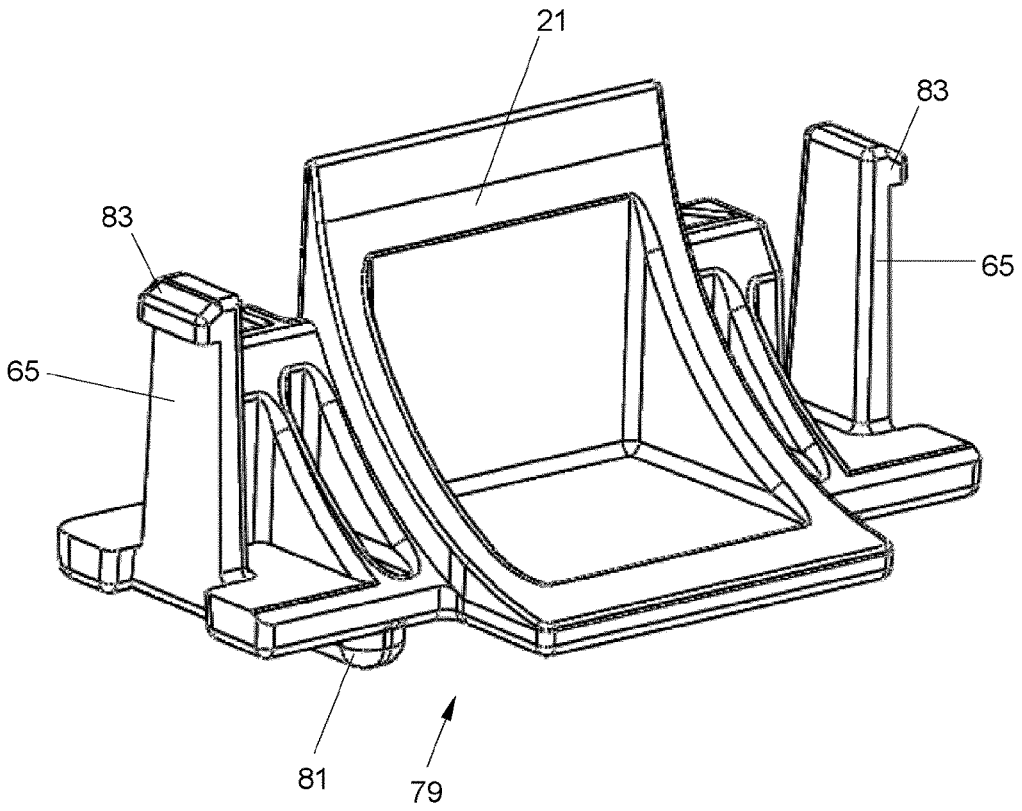
FIG. 15 is a perspective view from above of the guiding insert of FIG. 14.

FIG. 14 is a perspective view from below showing the guiding insert 79. As shown in FIG. 14, the guiding insert 79 is clearly shown to have a pair of torques 65 extending from the sides thereof, with a respective detent 83 on a free end thereof for engaging the opening 67 (shown in FIGS. 4, 12 and 13). The insert 79, as can be seen in FIGS. 14 and 15 is also provided with the guide members deflector 21. FIG. 15 is a perspective view of the guiding insert 79, as seen from above.

Figure 16:
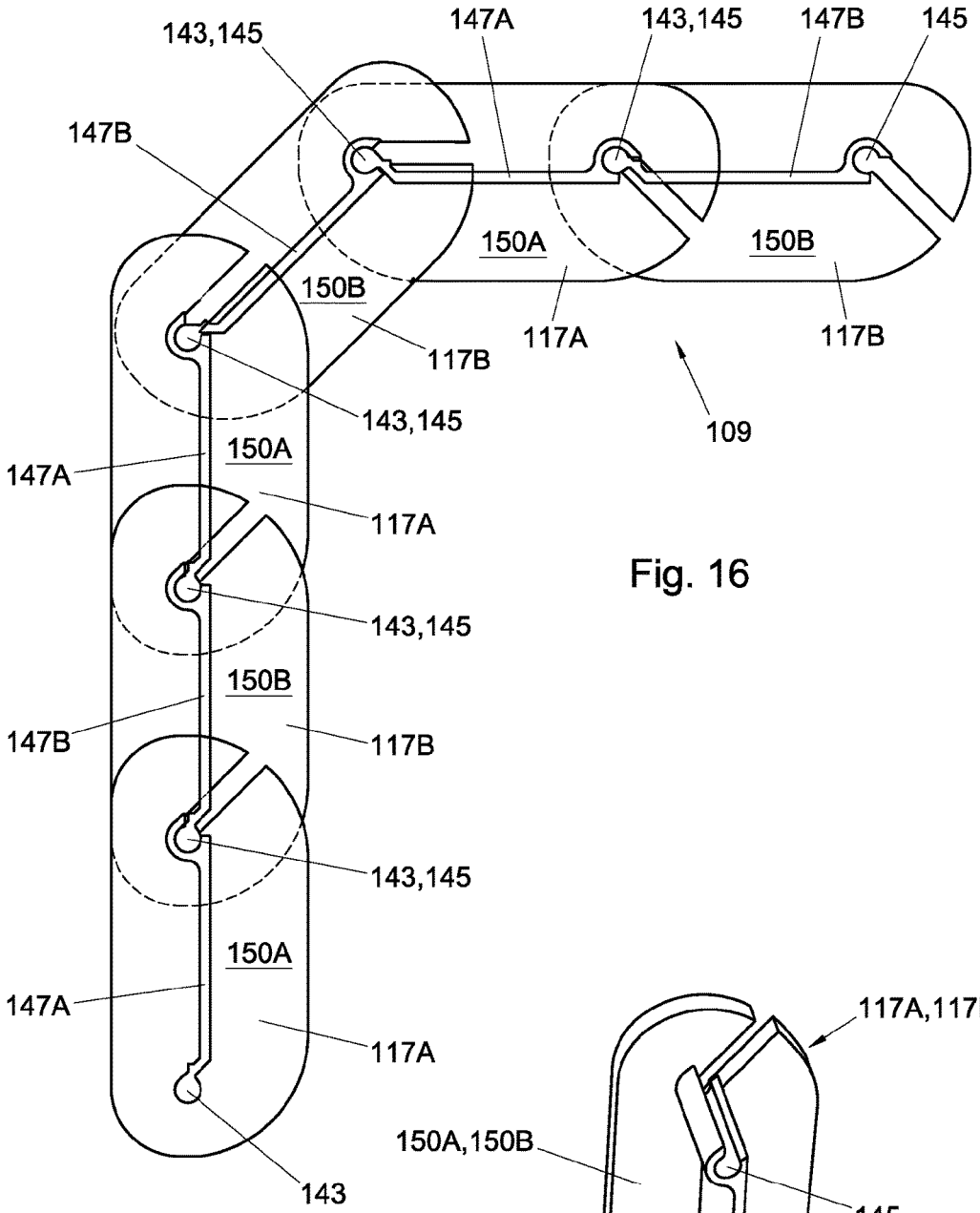
FIG. 16 is a ghost view in elevation of an alternative flexible guide member having differently hinged chain links.
Figure 17:
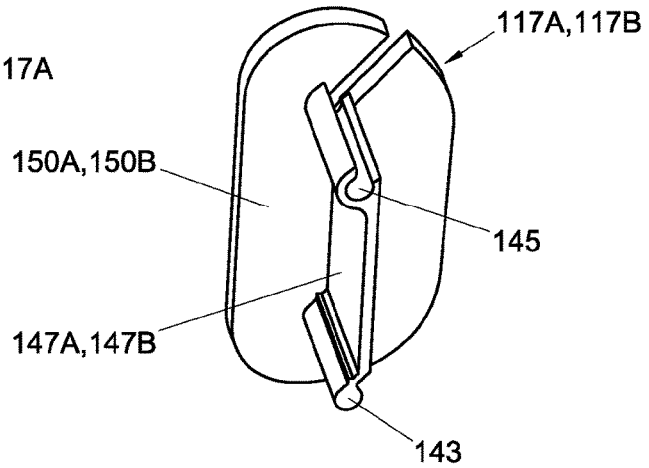
FIG. 17 is a partial cross section in perspective of an individual chain link of the flexible guide member of FIG. 16.

An alternative flexible guide member 109 having differently hinged chain links 117A, 117B is shown as a ghost view elevation in FIG. 16. An exemplary representation of the individual chain link 117A, 117B of the flexible guide member 109 is shown in FIG. 17 as a partial cross section in perspective. The alternative flexible guide member 109 includes pivotally interconnected chain links 117A of a first type alternated with chain links 117B of a second type. The first type of chain link 117A has a first central web 147A and the second type of chain link 117B has a second control web 147B.

The second central web 147B is wider than the first central web 147A. As a result a parallel pair of first opposite side flanges 150A of the first type chain link 117A is spaced laterally to define therebetween a cavity for accommodating an edge of the screen member (not shown but identical to screen member 7). A parallel pair of second opposite parallel side flanges 150B of the second type chain link 117B is spaces, so that outer surfaces of the first opposite side flanges 150A are engaged by inner surfaces of the second opposite side flanges 150B. Each of the first and second central webs 147A, 147B has an integrally formed hinge pin 143 on one of its longitudinal ends and a hinge mouth 145 on an opposite one of its longitudinal ends. The shape of the fringe mouth 145 is such that material flexibility allows snap-fittingly engaging a hinge pin 143 of one chain link 117A, 117B into the hinge mouth 145 of an adjacent chain link 117B, 117A, and so forth. Thereby the flexible guide member 109 will be formed to whatever length that may be required.

While thus alternative forms of flexible guide members 9, 11, 109 have been described in reference to FIGS. 5, 6, 16 and 17, it will be clear to the skilled person that other forms are also possible. As a further example the skilled person may also avail himself of the teachings provided by U.S. Pat. No. 3,284,036, U.S. Pat. No. 3,664,619, or U.S. Pat. No. 4,392,344 for possible other forms of chain links, interconnected by hinge connections.

Figure 18B:
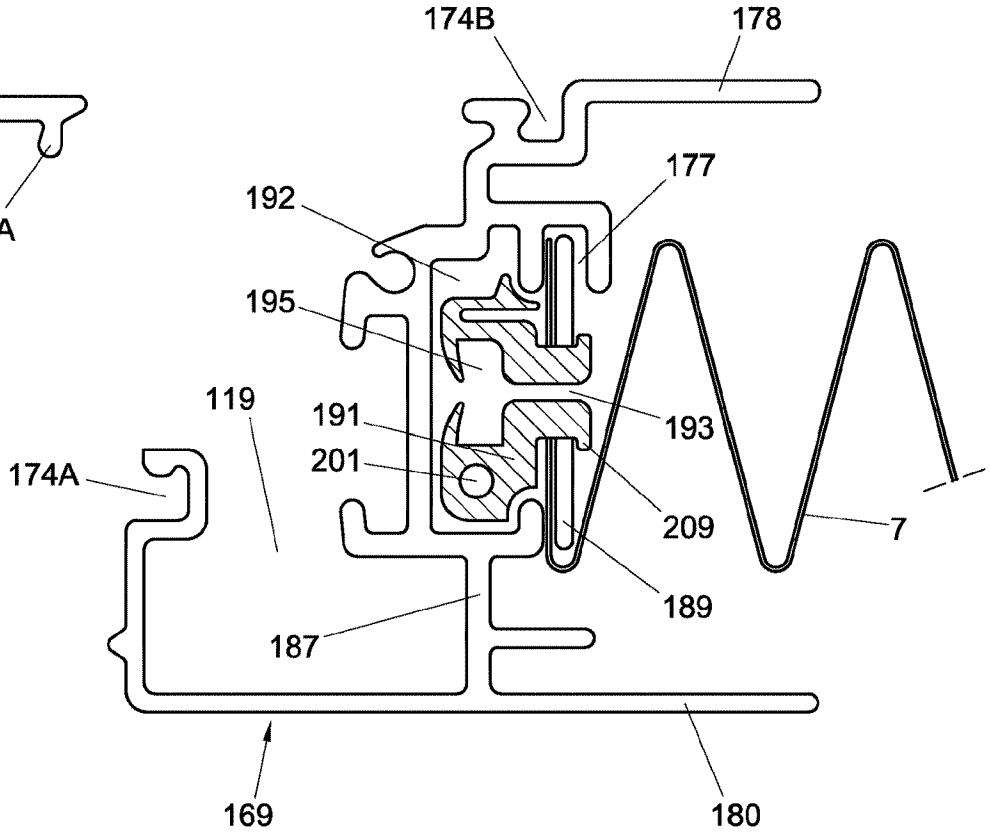
FIG. 18B is a longitudinal end view of a slightly modified form of base profile including a pleated screen member attached thereto.
Figure 18A:
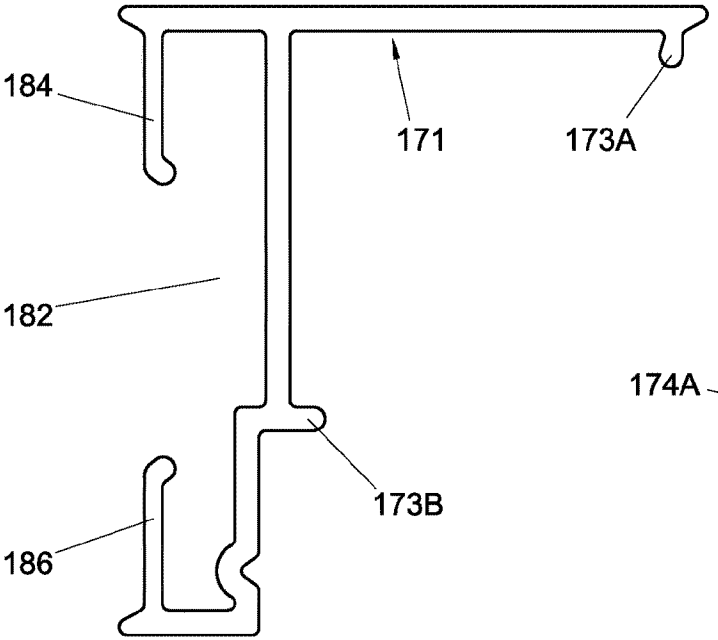
FIG. 18A is a longitudinal end view of an alternative form of auxiliary profile.

An alternative form of auxiliary profile 171 in a longitudinal end view is shown in FIG. 18A. The alternative form of auxiliary profile 171 differs from the auxiliary profile 71 of FIGS. 10 and 11, in that it has a relatively wide undercut mounting groove 182 on one side, bordered by opposite inturned flanges 184 and 186. The inturned flanges 184, 186 are useful in engaging of mounting brackets for mounting of the screen device in or on an architectural opening in a manner well known in the art. Hence for clarity a description of a suitable mounting bracket to cooperate with the mounting groove 182 is deemed superfluous. Holding formations 173A, 173B are provided on the auxiliary profile 171 to cooperate with complementary formations of the base profile 69 in a similar manner as described for the auxiliary profile 71 of FIGS. 10 and 11. Accordingly the holding formations 173A, 173B are also equivalently engageable with each of the complementary formation of the base profile, so that the auxiliary profile 171 can be mounted in a selective one or two different positions. Thereby the mounting groove 182 of the generally L-shaped auxiliary profile 171 can have its opening in a plane parallel, or perpendicular, to a plane in which the covering device extends.

Apart from cooperating with the base profile 69 of FIGS. 10 and 11, the alternative auxiliary profile 171 can also cooperate with a slightly modified form of base profile 169 as shown in FIG. 18B.

The modified form of base profile 161 illustrated in FIG. 18B with a pleated screen member attached thereto is shown according to a longitudinal end view thereof. The modified base profile 169 has mounting formations 174A, 174B to one side of a central web portion 187 where a hollow interior defines a guide track 119 receiving one of the first and second flexible guide members 9, 11, 109. Each mounting formation 174A, 174B is adapted to cooperate with either one of the holding formations 173A, 173B of the alternative auxiliary profile 171, but also with either one of the snap-fit formations 74*a*, 74*b* of the auxiliary profile 71. The central web portion 187 on an opposite side is provided with locating means 177 for mounting of a screen member 7 and first and second flanges 178, 180 for shielding the pleated screen member 7 when it is retracted against the central web portion 187. For mounting the screen member 7 to the modified base profile 169, an end pleat of the pleated screen member 7 is attached to a fitting strip 189. The fitting strip 189 with one of its longitudinal edges engages the locating means 177.

As will be explained in more detail below, the fitting strip 189 also has mounted thereto along its length a plurality of cord guide blocks 191, which mount the fitting strip 189 to a recessed groove 192 of the central web portion 187. The cord guide blocks 191 also serve in the redirection and attachment of tension cords, such as the tension cords 29, 31 shown in FIG. 1.

Figure 19A:
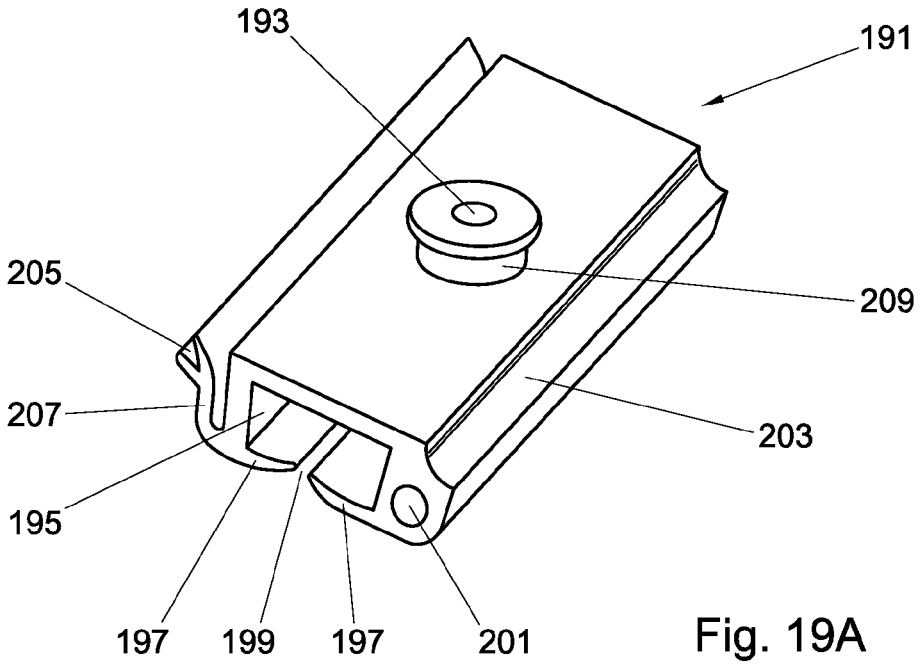
FIGS. 19A and 19B are opposite perspective views of a redirecting cord guide block for use with the base profile of FIG. 18B.
Figure 19B:
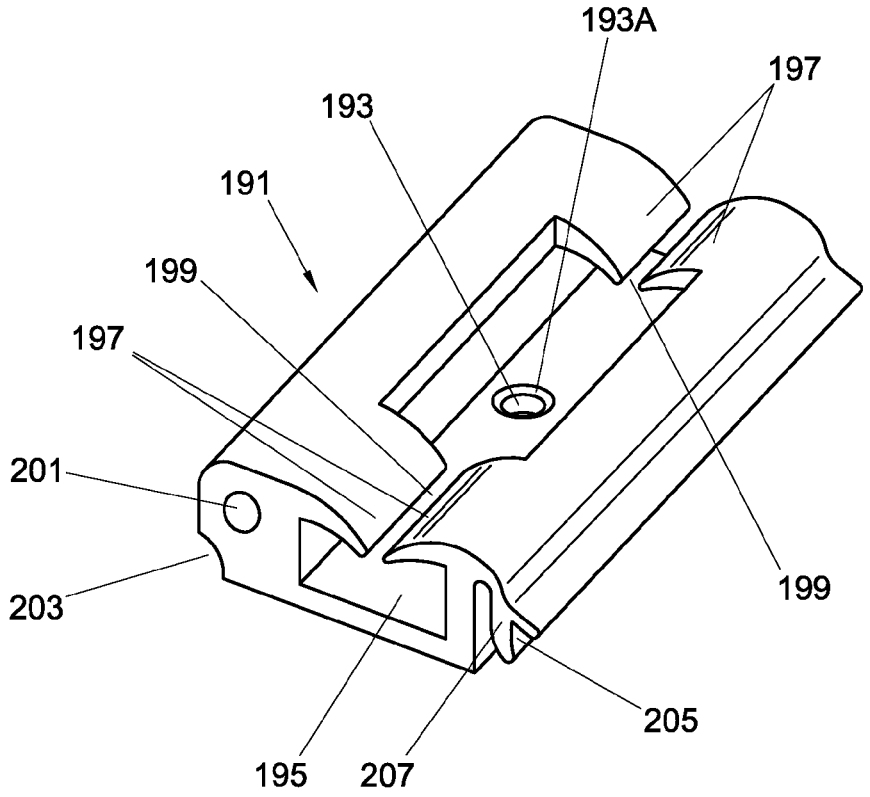

The cord guide block 191 for use with the base profile 169 is shown more detailed in opposite perspective views in FIGS. 19A and 19B. Each cord guide block 191 is provided with a central through bore 193 for receiving a tension cord, such as 29 or 31 that extends through the pleated screen member 7 for redirecting it in a direction substantially parallel to the fitting strip 189. To this end the through bore 193 which extends through a protuberance 209, is provided with a rounded perimeter edge 193A to deflect and guide a tension cord to extend through an inner pathway 195 extending lengthwise of the cord guide block 191. An open end to the inner pathway 195 has inwardly directed cord retaining tongues 196 defining a cord entry slot 199 therebetween. The cord guide block 191 further has a longitudinal bore 201 for optional attachment of a cord end, such as the ends 29A, 31A of the tensioning cord as shown in FIG. 1.

Further the cord guide block 191 is provided with opposite first and second stepped edges 203, 205 for engaging behind opposite edges of the recessed groove 192 of the base profile 169. The second stepped edge 205 is positioned on a resilient arm portion 207 to allow the cord guide block 191 to be snap-fitted in engagement with the recessed groove 192. Conveniently the cord guide block 191 is made from a plastic material with good wear resistance against cord abrasion. One suitable example of such a plastic material is a Polyetherimide (PEI) sold under the name of ULTEM by the company of SABIC and before by General Electric's Plastic Division.

Figure 20:
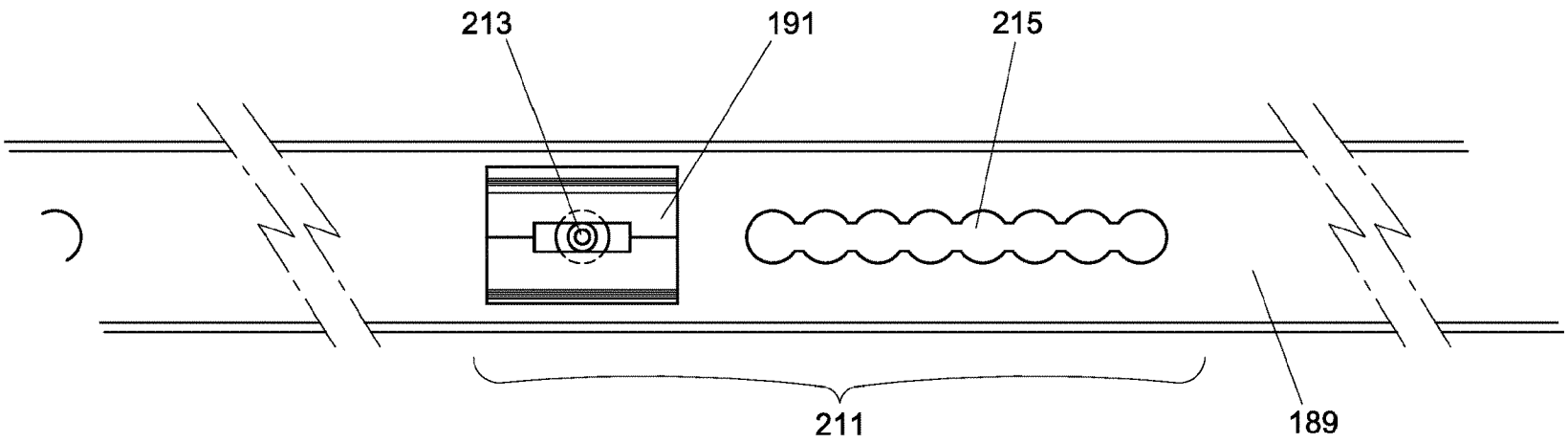
FIG. 20 is a partly assembled fitting strip for mounting a pleated screen member to the base profile of FIG. 18B.

Reverting now to FIG. 20 a partly assembled fitting strip 189 for mounting a pleated screen member 7 to the base profile 169 is shown. The fitting strip 189, of which only a portion is shown in FIG. 20, has a repetitive pattern 211 along its length composed of a single circular opening 213 and a serrated slot 215 of a plurality of overlapping circular openings. Both the circular opening 213 and the slot 215 are provided for receiving the protuberance 209 of the cord guide block 191 for its attachment to the fitting strip 189. In FIG. 20 only a single cord guide block 191 is shown, which is attached to the circular opening 213 and thereby more clearly shows the serrated slot 215. However it is to be understood that a further cord guiding block 191 may be attached in a selective one of eight different positions provided along the length of the serrated slot 215. The serrated slot 215 thereby will offer different and adjustable tensioning positions for a cord end (such as 29A, 31A of FIG. 1) of a tensioning cord that is attached to the longitudinal bore 201 of a guiding block 191 that attaches to the serrated slot 215. Clearly the example of a serrated slot with eight positions of adjustment is not a limiting requirement and other numbers of selectable position may be conceived by the skilled individual.

Figure 21:
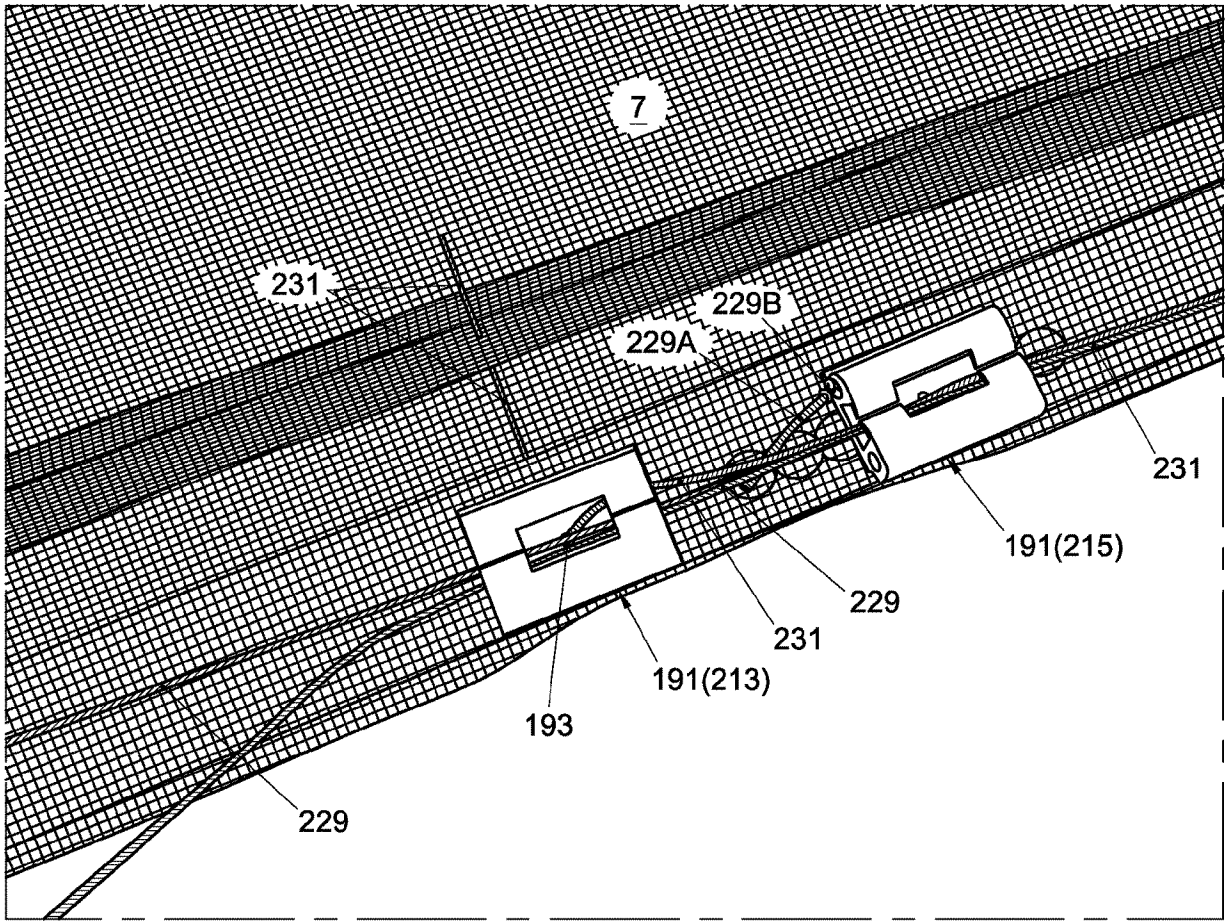
FIG. 21 is a perspective fragmentary view of a pleated screen member and fitting strip detached from a base profile.

A perspective fragmentary view of the pleated screen member 7 with its fitting strip 189 detached from a base profile 69, 169 is illustrated in FIG. 21. The fitting step 189 is here hidden underneath the screen member 7 and one cord guide block 191 is attached with its protuberance 209 in circular opening 213 (both hidden from view) and another cord guide block 191 is attached through the screen material in selected position to the serrated slot 215. In FIG. 21 the respective location of the cord guide blocks 191 is indicated by giving the relevant reference numeral of the opening and slot between brackets. It is further illustrated in FIG. 21 that a first tensioning cord 229 passes through the inner pathway 195 of the left hand guide block 191 (213) and then through the inner pathway 195 of the right hand guide block 191 (215). A free 229A end of the first tensioning cord 229 is returned through the longitudinal bore 201 of the right hand guide block 191 (215) and retained thereto by a knot 229B. A second tensioning cord 231 passes through the right hand guide block 191 (215) and extends therefrom to the pathway 195 of the left hand guide block 191 (213), where it is deflected through the through bore 193 to extend through the pleated screen member 7. While for clarity the screen member 7 and the fitting strip are not yet attached to a base profile, FIG. 22 will show the mounted position.

Figure 22:
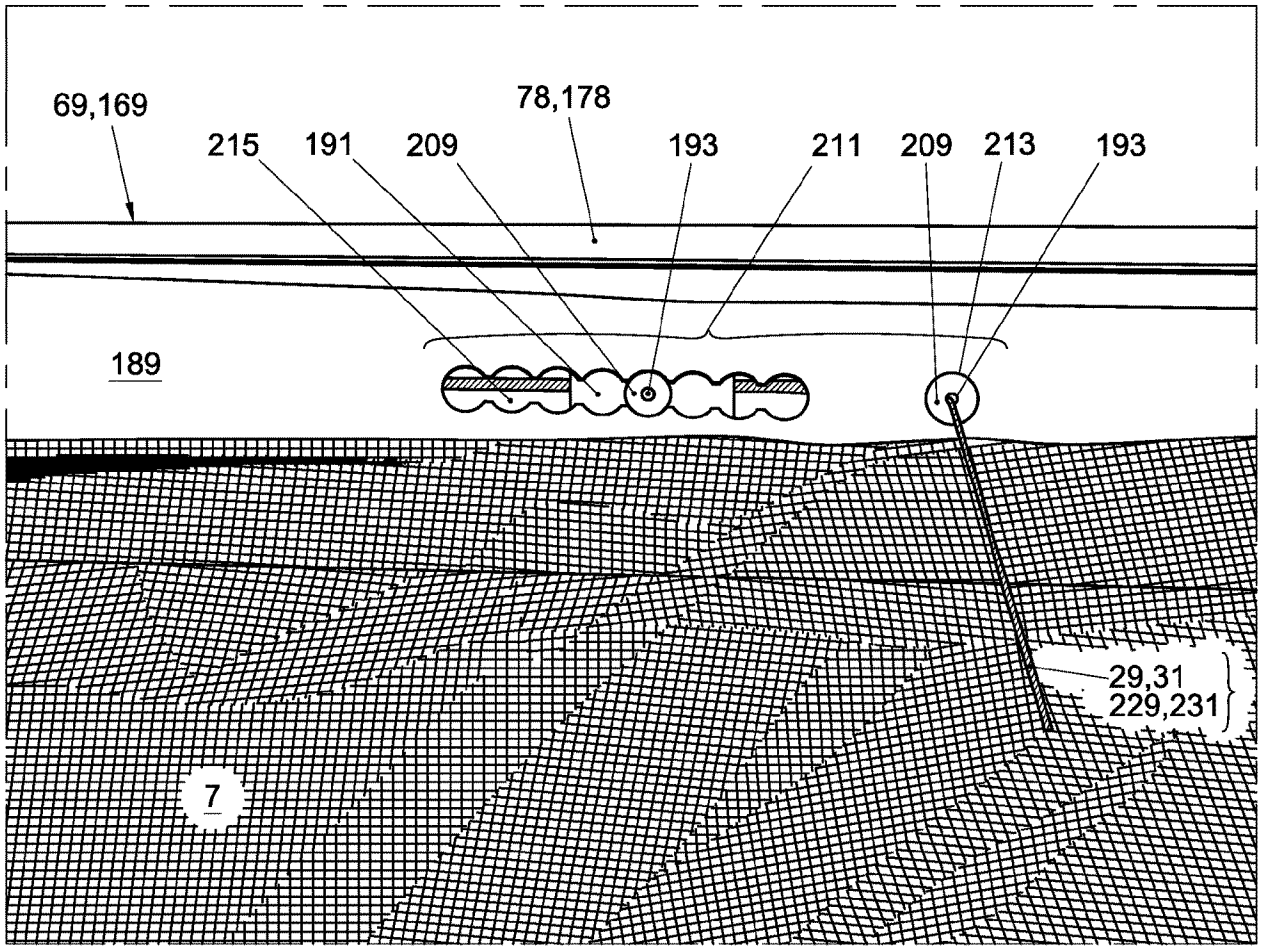
FIG. 22 is a perspective fragmentary view of a pleated screen member and fitting strip attached to a base profile, showing a side of the fitting strip opposite to that of FIG. 21.

The pleated screen member 7 and fitting strip 189 attached to a base profile, such as 169, is illustrated in FIG. 22. FIG. 22 is a perspective fragmentary view that shows a side of the fitting strip 189 opposite to that shown in FIG. 21. It is seen that a tensioning cord, such as 29, 31, 229, or 231, enters a through bore 193 of a protuberance 209 of a guide block 191 engaged in circular opening 213 in the fitting strip 189. On the reverse of fitting strip 189 the tensioning cord will be deflected as described above in reference to FIG. 21. Another cord guide block 191 is engaged with its protuberance 209 in a selected portion along the serrated slot 215. This other cord guide block is used only for fixing a tension cord end, such as 29A, 31A, or 229A, in relation to a base profile 69, 169 by means of the fitting strip 189. As already explained in reference to FIG. 20 the circular opening 213 and the serrated slot 215 together form a pattern 211 that is repeated on the fitting strip 189 and along the base profile 69, 169 as many times as there are tension cords routed through the pleated screen member 7. The fragmentary view of FIG. 22 shows only a single pattern 211. No tension cord will extend from the through bore 193 of the cord guiding block 191 that engages the serrated slot 215. This particular cord guiding block 191 is only used for anchoring one of the tensioning cords to the base profile 69, 169, of which the first flange 78, 178 is also visible in FIG. 22.

A particular aspect of this arrangement is, that the general flexibility of the fitting strip 189 and of the cord guide block 191, in conjunction with the clearance provided in the recessed groove 192 (see FIG. 18B) allows the cord tension to be adjusted. Adjustment of the cord tension can be achieved with the covering device assembled as shown in FIG. 22. In this condition the screen member 7 may be moved aside just enough to have access to the end of the through bore 193 of the guide block 191 that is engaged in the serrated slot 215. By engaging the protuberance 209 and/or the bore 193 with a suitable tool and exerting pressure thereon, the respective protuberance 209 can be moved at will from one indexing position to another.

Upon releasing the exerted pressure the protuberance 209 will again be firmly engaged between serrations of the serrated slot 215. With the known covering devices it has not been possible to adjust the tension of the stabilizing cords, without at least a certain amount of disassembly. The present arrangement allows adjustment to be performed with the covering device already installed in or on an architectural opening, and to do so without any disassembly.

Accordingly a retractable and extendable covering device (1) for architectural openings is disclosed that is useful as an insect screen door. The retractable and extendable covering device (1) thus includes first and second substantially parallel posts (3, 5), a retractable and extendable substantially rectangular screen member (7), and a first flexible guide member (9; 109). The first flexible guide member (9; 109) is deflected into one of the first and second posts (3, 5) and is slidably receivable therein. Each of the parallel posts (3, 5) has a hollow interior (19, 23), and at least one of the first and second posts being movable toward and away with respect to the other. The retractable and extendable screen member (7) has first and second pairs of opposite parallel edges and is mounted between the first and second parallel posts (3, 5) at its first pair of parallel edges. The first flexible guide member (9; 109) extends along one edge of the second pair of parallel edges of the screen member (7) and between the first and second posts (3, 5) for retaining the one edge of the screen member (7). The first and second parallel posts (3, 5) each include a base profile part (69; 169) and an auxiliary profile part (71; 171) defining the hollow interior therebetween suitable for slidably receiving therein the first flexible guide member (9; 109). Optionally a second flexible guide member (11) extends along the other edge of the second pair of parallel edges of the screen member (7) for retaining the other edge. The second flexible guide member (11) is deflected and slidably receivable within one of the first and second posts (3, 5) other than that in which the first flexible guide member (9; 109) is received.

It is thus believed that the operation and construction of the present invention will be apparent from the foregoing description. To the skilled person in this field of the art it will be clear that the invention is not limited to the embodiment represented and described here, but that within the framework of the appended claims a large number of variants are possible. Also kinematic inversions are considered inherently disclosed and to be within the scope of the present invention. The terms comprising and including when used in this description or the appended claims should not be construed in an exclusive or exhaustive sense but rather in an inclusive sense. Expressions such as: "means for . . . " should be read as: "component configured for . . . " or "member constructed to . . . " and should be construed to include equivalents for the structures disclosed. The use of expressions like: "critical", "preferred", "especially preferred" etc. is not intended to limit the invention. Features which are not specifically or explicitly described or claimed may be additionally included in the structure according to the present invention without deviating from its scope.

The invention claimed is:

1. A retractable and extendable covering device for architectural openings, including:

first and second substantially parallel posts, each having a hollow interior, and at least one of the first or second posts being movable toward and away with respect to the other of the first or second posts;

a retractable and extendable substantially rectangular covering member having first and second pairs of opposite parallel edges and being mounted between the first and second parallel posts at the first pair of parallel edges;

a first flexible guide member extending along one edge of the second pair of parallel edges and between the first and second posts for retaining the one edge of the covering member; and the first flexible guide member being deflected into the hollow interior of one of the first or second posts and being slidably receivable therein, wherein the first and second posts each include a base profile part and a separate auxiliary profile part, each separate auxiliary profile part being configured to define the hollow interior of each of the respective first and second posts when connected to its respective base profile part, wherein each separate auxiliary profile part is of an L-shaped configuration defining two faces that are perpendicular to one another with only one face having a hardware receiving structure comprising a mounting groove, and wherein each separate auxiliary profile part is connectable to its respective base profile part in different first and second positions, wherein in the first position, the mounting groove opens to a front or rear face of the covering device wherein, in the second position, the mounting groove opens to an outer side face, orthogonal to the front or rear face of the covering device, and wherein, in either the first or the second position, the mounting groove is configured to engage external mounting hardware.

2. The retractable and extendable covering device according to claim 1, wherein the first and second posts are identical.

3. The retractable and extendable covering device according to claim 1, wherein a second flexible guide member extends along the other edge of the second pair of parallel edges of the covering member for retaining the other edge, and wherein the second flexible guide member is deflected and slidably receivable within the hollow interior of the one of the first or second posts other than that in which the first flexible guide member is received.

4. The retractable and extendable covering device according to claim 1, wherein a first type of end member is mounted to a first longitudinal end of the first post and also to a second longitudinal end of the second post.

5. The retractable and extendable covering device according to claim 4, wherein a second type of end member is mounted to a second longitudinal end of the first post and also to a first longitudinal end of the second post.

6. The retractable and extendable covering device according to claim 1, wherein at least the first flexible guide member has a transverse cross section adapted to accommodate an edge of the second pair of parallel edges of the covering member, which extends between the first and second posts.

7. The retractable and extendable covering device according to claim 6, wherein at least the first flexible guide member is adapted to engage a fixed guide rail and defines a formation that is complementary to a transverse contour of the fixed guide rail.

8. The retractable and extendable covering device according to claim 1, wherein at least the first flexible guide member includes a plurality of pivotally interconnected chain links.

9. The retractable and extendable covering device according to claim 8, wherein each chain link comprises side flanges, which are laterally spaced by a central web that is aligned with the pivot connections, and wherein the central web and pivot connections are asymmetrically positioned to define a cavity for receiving the covering member edge that is deeper than a cavity for engaging a fixed guide rail.

10. The retractable and extendable covering device according to claim 4, wherein a second type of end member is mounted to a second longitudinal end of the first post and also to a first longitudinal end of the second post, and wherein the second type of end member includes a guide member deflector for deflecting one of the first and second flexible guide members into a relevant one of the first and second posts.

11. The retractable and extendable covering device according claim 10, wherein the guide member deflector is part of a separate guiding insert that is removable mounted to the second end member.

12. The retractable and extendable covering device according to claim 1, wherein at least one tension cord extends parallel to the second pair of parallel edges of the covering member and through aligned openings or eyelets of the covering member.

13. The retractable and extendable covering device according to claim 1, wherein a central web portion of each base profile part is provided with a locator for mounting the screen member by a fitting strip and wherein the covering member is attached to each fitting strip.

14. The retractable and extendable covering device according to claim 13, wherein the fitting strip has mounted thereto along its length a plurality of cord guide blocks, and wherein the plurality of cord guide blocks mount the fitting strip to a recessed groove in the central web portion.

15. The retractable and extendable covering device according to claim 14, wherein the cord guide blocks are each provided with opposite first and second stepped edges for engaging behind opposite edges of the recessed groove of each base profile part, and wherein the second stepped edge is on a resilient arm portion to allow each cord guide block to be snap-fitted in engagement with the recessed groove.

16. The retractable and extendable covering device according to claim 14, wherein the fitting strip has a repetitive pattern along its length composed of a circular opening and a serrated slot for each receiving one of the cord guide blocks.

17. The retractable and extendable covering device according to claim 16, wherein one of the cord guide blocks is configured to be attachable in a selective one of different positions along the length of the serrated slot, and wherein the serrated slot thereby offers adjustable tensioning for a tensioning cord having an end thereof attached to the cord guide block attached to the serrated slot.

18. The retractable and extendable covering device according to claim 1, wherein both the first and second post are movable for retracting and extending the covering member.

19. The retractable and extendable covering device according to claim 1, wherein ends on one side of the parallel first and second posts are guided by a valance profile.

20. The retractable and extendable covering device according to claim 19, wherein the valance profile has a separately attached front wall.

21. The retractable and extendable covering device according to claim 1, wherein the covering member is a pleated insect screen and the covering device is an insect screen door.

22. The retractable and extendable covering device according to claim 1, wherein the respective mounting groove of each separate auxiliary profile part is a longitudinally extending dovetail groove.

* * * * *